US011767852B2

(12) United States Patent
Kim et al.

(10) Patent No.: US 11,767,852 B2
(45) Date of Patent: Sep. 26, 2023

(54) BLOWER

(71) Applicant: LG ELECTRONICS INC., Seoul (KR)

(72) Inventors: Jaehyeon Kim, Seoul (KR); Yongmin Kim, Seoul (KR); Kidong Kim, Seoul (KR); Seokho Choi, Seoul (KR); Hyungho Park, Seoul (KR); Hoojin Kim, Seoul (KR); Chiyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/197,918

(22) Filed: Mar. 10, 2021

(65) Prior Publication Data

US 2021/0285454 A1 Sep. 16, 2021

(30) Foreign Application Priority Data

Mar. 11, 2020 (KR) ..... 10-2020-0030015
Jun. 2, 2020 (KR) ..... 10-2020-0066278
(Continued)

(51) Int. Cl.
*F04D 29/44* (2006.01)
*F04D 25/08* (2006.01)
(Continued)

(52) U.S. Cl.
CPC ..... *F04D 25/08* (2013.01); *F04D 29/002* (2013.01); *F04D 29/30* (2013.01); *F04D 29/441* (2013.01); *F04D 29/703* (2013.01)

(58) Field of Classification Search
CPC ..... F04D 25/08; F04D 29/002; F04D 29/30; F04D 29/441; F04D 29/703;
(Continued)

(56) References Cited

U.S. PATENT DOCUMENTS

2012/0051884 A1 3/2012 Junkel et al.
2014/0373563 A1* 12/2014 Mizutani ..... B60H 1/32 62/186
(Continued)

FOREIGN PATENT DOCUMENTS

CN 206877265 1/2018
EP 3 348 840 7/2018
(Continued)

OTHER PUBLICATIONS

European Search Report issued in Application No. 21161800.4 dated Aug. 2, 2021.
(Continued)

*Primary Examiner* — Aaron R Eastman
(74) *Attorney, Agent, or Firm* — KED & ASSOCIATES, LLP

(57) ABSTRACT

A blower may include a lower case having a suction port and a fan and an upper case having at least one main discharge port and at least one auxiliary discharge port. The auxiliary discharge port may be positioned in front of and below the main discharge port to discharge air introduced through the suction port upward. A door may open and/or close the auxiliary discharge port, and a door motor may power the door. The upper case may be formed as two towers defining a blowing space therebetween, and the at least one auxiliary discharge port may include a plurality of auxiliary discharge ports formed in inner walls of the two towers to face each other.

25 Claims, 12 Drawing Sheets

(30) Foreign Application Priority Data

Jun. 2, 2020 (KR) ..... 10-2020-0066279
Jun. 2, 2020 (KR) ..... 10-2020-0066280

(51) Int. Cl.
*F04D 29/00* (2006.01)
*F04D 29/30* (2006.01)
*F04D 29/70* (2006.01)

(58) Field of Classification Search
CPC ..... F04D 29/444; F04D 29/4226; F04F 5/16; F04F 5/44; F04F 5/461; F04F 5/466; F04F 5/48
See application file for complete search history.

(56) References Cited

U.S. PATENT DOCUMENTS

| | | | |
|---|---|---|---|
| 2019/0134548 | A1 | 5/2019 | Yoon |
| 2019/0376527 | A1 | 12/2019 | Huang et al. |

FOREIGN PATENT DOCUMENTS

| | | |
|---|---|---|
| GB | 2568979 | 6/2019 |
| JP | 2013-015114 | 1/2013 |
| JP | 2015-152005 | 8/2015 |
| JP | 2017-172358 | 9/2017 |
| JP | 2019-100341 | 6/2019 |
| KR | 10-2011-0099318 | 9/2011 |
| KR | 10-2013-0033435 | 4/2013 |
| KR | 10-2018-0032438 | 3/2018 |
| KR | 10-2018-0125425 | 11/2018 |
| WO | WO 2013/035271 | 3/2013 |
| WO | WO 2017/198763 | 11/2017 |

OTHER PUBLICATIONS

Extended European Search Report dated Feb. 7, 2023 issued in Application No. 22199693.7.

* cited by examiner

BLOWER

CROSS-REFERENCE TO RELATED APPLICATIONS

This application claims priority under 35 U.S.C. § 119 to Korean Application No. 10-2020-0030015, filed in Korea on Mar. 11, 2020, 10-2020-0066278, filed in Korea on Jun. 2, 2020, 10-2020-0066279, filed in Korea on Jun. 2, 2020, and 10-2020-0066280, filed in Korea on Jun. 2, 2020, the contents of all of which are incorporated by reference herein in their entirety.

BACKGROUND

1. Field

The present disclosure relates to a blower.

2. Background

A blower may create a flow of air to circulate air in an indoor space, or to guide an air flow toward a user. When the blower is provided with a filter, the blower may improve indoor air quality by purifying contaminated air in a room.

The blower may include a case forming an external shape and a fan that is provided in the case to generate a flow of air. To adjust a flow direction of air discharged through the blower, the case or fan of the blower may be rotated, and the discharged airflow direction may depend on the movement of the case or fan. However, an excessive amount of power may be consumed in moving or adjusting the air flow by moving the case or fan, and noise due to vibration may occur.

BRIEF DESCRIPTION OF THE DRAWINGS

Embodiments will be described in detail with reference to the following drawings in which like reference numerals refer to like elements, and wherein.

DETAILED DESCRIPTION

Figure 1:
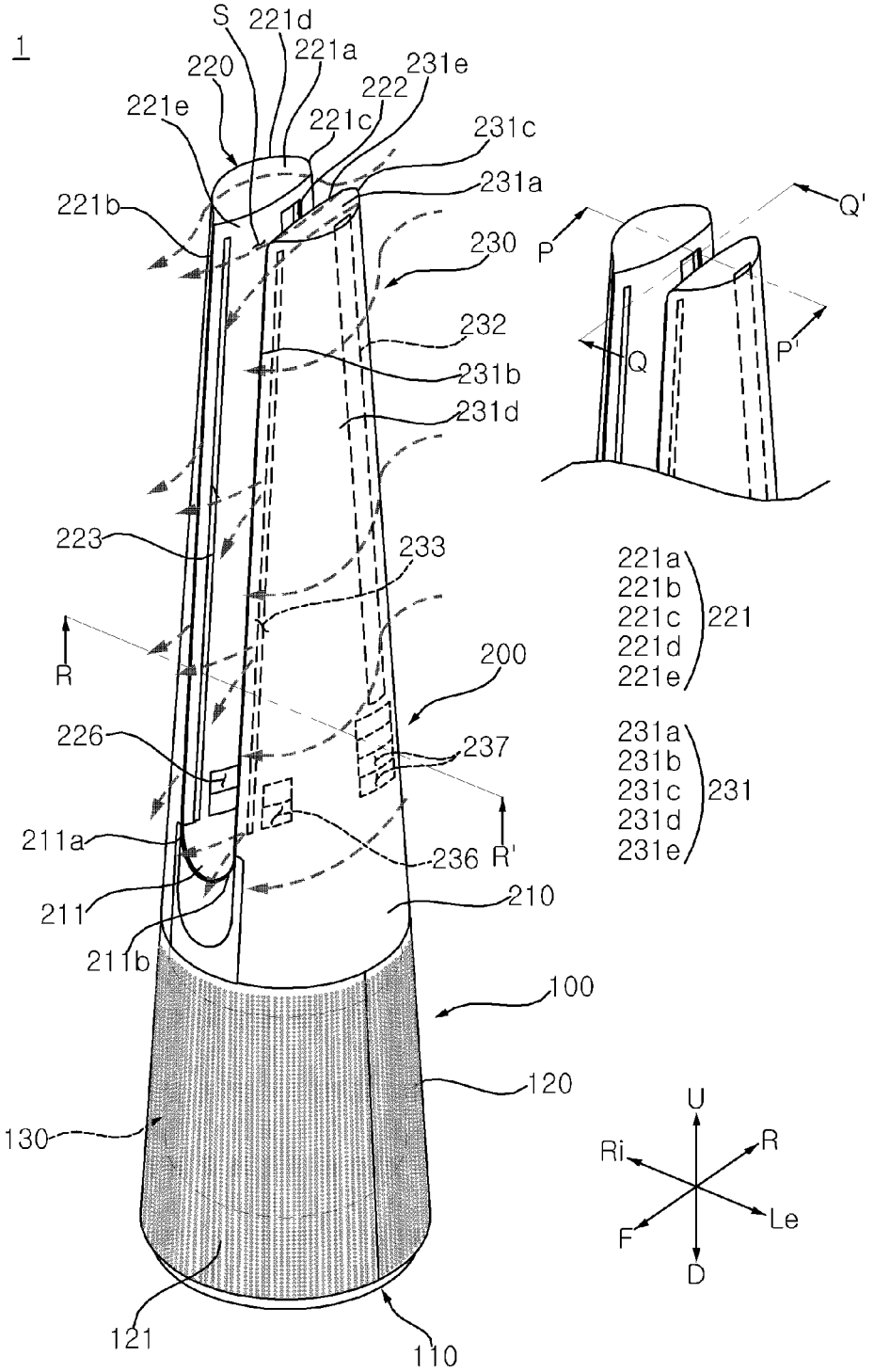
FIG. 1 is a perspective view of a blower according to an embodiment.

An overall structure of a blower 1 will be described first. FIG. 1 shows a whole appearance of the blower 1.

Referring to FIG. 1, the blower 1 may alternatively be referred to or implemented as an air conditioner, an air clean fan, or an air purifier where air is suctioned and the suctioned air is circulated. The blower 1 according to an embodiment of the present disclosure may include a suction module or assembly 100 through which air is suctioned and a blowing module or assembly 200 through which the suctioned air is discharged.

The blower 1 may have a column or cone shape whose diameter decreases upward or toward the blowing module 200, and the blower 1 may have a shape of a cone or truncated cone as a whole. As a cross-section and/or weight increases toward a bottom, a center of gravity may be lowered, reducing a risk of tipping. However, configuring the cross section to narrow toward the top is not necessary.

The suction module 100 may have a cross-sectional arear or diameter that gradually decreases the top. The blowing module 200 may also have a cross-sectional area or diameter that gradually decreases toward the top. The blowing module 200 may be provided above the suction module 100, and diameters of the suction module 100 and blowing module 200 may be configured such that a transition appears smooth or seamless.

The suction module 100 may include a base 110, a lower case 120 provided above the base 110, and a filter 130 provided inside the lower case 120. The base 110 may be seated on a ground, floor, or other surface and may support a weight of the rest of the blower 1. The lower case 120 and the filter 130 may be placed in the upper side of the base 110.

An outer shape of the lower case 120 may be conical (or alternatively cylindrical), and a space in which the filter 130 is provided may be formed inside the lower case 120. The lower case 120 may have a suction port 121 opened to an inside of the lower case 120. A plurality of suction ports 121 may be formed along a circumferential surface of the lower case 120. An outer shape of the filter 130 may be cylindrical (or alternatively, conical). Foreign matter contained in the air introduced through the suction port 121 may be filtered by the filter 130.

The blowing module 200 may have a slot or opening penetrating a middle portion so as to appear to be separated and having two columns extending vertically. The slot or opening may define a blowing space S described in more detail later. The blowing module 200 may include a first tower or extension 220 and a second tower or extension 230 spaced apart from each other. The blowing module 200 may include a tower base or connector 210 connecting the first tower 220 and the second tower 230 to the suction module 100. The tower base 210 may be above an upper side of the suction module 100 and may be provided at a lower side of the first and second tower 220 and 230.

An outer shape of the tower base 210 may be conical (or alternatively, cylindrical), and the tower base 210 may be provided on an upper surface of the suction module 100 to form an outer circumferential surface continuous with the suction module 100.

An upper surface 211 of the tower base 210, hereinafter called the tower base upper surface 211, may be concaved downward to form a recess or groove extending forward and backward. The first tower 220 may extend upward from a first side 211*a* (e.g., a left side) of the tower base upper surface 211, and the second tower 230 may extend upward from the a second side 211*b* (e.g., a right side) of the tower base upper surface 211.

The tower base 210 may distribute filtered air supplied from an inside of the suction module 100 and provide the distributed air to the first tower 220 and the second tower 230. The tower base 210, the first tower 220, and the second tower 230 may be manufactured as separate components, or alternatively may be manufactured integrally. The tower base 210 and the first tower 220 may form a first continuous outer circumferential surface of the blower 1, and the tower base 210 and the second tower 230 may form a second continuous outer circumferential surface of the blower 1. As an alternative to the embodiment shown in FIG. 1, the first tower 220 and the second tower 230 may be directly assembled to the suction module 100 without the tower base 210 or may be manufactured integrally with the suction module 100.

The first tower 220 and the second tower 230 may be spaced apart from each other, and a blowing space S may be formed between the first tower 220 and the second tower 230. The blowing space S may be understood as a space between the first and second towers 220 and 230 which has open front, rear, and upper sides. The outer shape of the blowing module 200 including the first tower 220, the second tower 230, and the blowing space S may be a conical (or alternatively, cylindrical) shape.

First and second discharge ports 222 and 232 respectively formed in the first tower 220 and the second tower 230 may discharge air toward the blowing space S. The first tower 220 and the second tower 230 may be provided symmetrically with respect to the blowing space S so that an air flow is uniformly distributed in the blowing space S, facilitating control of a horizontal airflow and a rising airflow.

The first tower 220 may include a first tower case 221 forming an outer shape of the first tower 220, and the second tower 230 may include a second tower case 231 forming an outer shape of the second tower 230. The tower base 210, the first tower case 221, and the second tower case 231 may be referred to as an upper case which is provided above the lower case 120 and has first and second discharge ports 222 and 232 through which air is discharged. The lower case 120 and the upper case defined by the tower base 210, first tower case 221, and second tower 231 may collectively be referred to as a "case."

The first discharge port 222 may be formed in the first tower 220 to extend vertically, and the second discharge port 232 may be formed in the second tower 230 to extend vertically. A flow direction of the air discharged from the first tower 220 and the second tower 230 may be formed in the front and rear direction.

A width of the blowing space S, which may be defined by a distance between the first tower 220 and the second tower 230, may be constant in the vertical direction. Alternatively, the width of the blowing space S may increase or decrease in the vertical direction.

Air flowing to a front of the blowing space S may be evenly distributed in the vertical direction by making the width of the blowing space S constant along the vertical direction. If a width of an upper side of the blowing space S differs from the width of a lower side of the blowing space S, a flow speed at the wider side may be lower than at the narrower side, and a deviation of speed may occur in the vertical direction. When a deviation of air flow speed occurs in the vertical direction, an amount of clean air supplied may vary according to a vertical position from which the air is discharged.

Air discharged from each of the first discharge port 222 and the second discharge port 232 may be supplied to a user after being joined in the blowing space S. The air discharged from the first discharge port 222 and the air discharged from the second discharge port 232 may not flow individually to the user, but may be supplied to the user after combining or mixing in the blowing space S. An indirect airflow may be formed in the air around the blower 1 due to air discharged to the blowing space S such that the air around the blower 1 may also flow toward the blowing space S.

Since the discharged air of the first discharge port 222 and the discharged air of the second discharge port 232 are joined in the blowing space S, a straightness or steadiness of the joined discharged air may be improved. By joining the discharged air in the blowing space S, the air around the first tower 220 and the second tower 230 may also be induced to flow forward along an outer circumferential surface of the blowing module 200.

The first tower case 221 may include a first tower upper end 221*a* forming an upper surface of the first tower 220, a first tower front end 221*b* forming a front surface of the first tower 220, a first tower rear end 221*c* forming a rear surface of the first tower 220, a first outer wall 221*d* forming an outer circumferential surface of the first tower 220, and a first inner wall 221*e* forming an inner surface of the first tower 220 facing the blowing space S.

Similarly, the second tower case 231 may include a second tower upper end 231*a* forming an upper surface of the second tower 230, a second tower front end 231*b* forming a front surface of the second tower 230, a second tower rear end 231*c* forming a rear surface of the second tower 230, a second outer wall 231*d* forming an outer circumferential surface of the second tower 230, and a second inner wall 231*e* forming an inner surface of the second tower 230 facing the blowing space S.

The first outer wall 221*d* and the second outer wall 231*d* may be formed to curve convexly outward in to radial direction so that outer circumferential surfaces of each of the first tower 220 and the second tower 230 are curved. The first inner wall 221*e* and the second inner wall 231*e* may be formed to curve convex inward toward the blowing space S in the radial direction so inner circumferential surfaces of each of the first tower 220 and the second tower 230 are curved.

The first discharge port 222 may be formed in the first inner wall 221*e* and extend in the vertical direction. The first discharge port 22 may be opened inward in the radial direction. The second discharge port 232 may be formed in the second inner wall 231*e* and extend in the vertical direction. The second discharge port 232 may be opened inward in the radial direction.

The first discharge port 222 may be positioned closer to the first tower rear end 221*c* than the first tower front end 221*b*. The second discharge port 232 may be positioned closer to the second tower rear end 231*c* than the second tower front end 231*b*.

A first board slit 223 may be formed in the first inner wall 221*e* to extend vertically. A second board slit 233 may be formed in the second inner wall 231*e* to extend vertically. The first board slit 223 and the second board slit 233 may be formed to be opened inward in the radial direction. A first airflow converter 401 (FIG. 6) described later may pass through the first board slit 223 and a second airflow converter 402 (FIG. 6) described later may pass through the second board slit 233.

The first board slit 223 may be positioned closer to the first tower front end 221*b* than the first tower rear end 221*c*. The second board slit 233 may be positiones closer to the second tower front end 231*b* than the second tower rear end 231*c*. The first board slit 223 and the second board slit 233 may face each other.

The blower 1 may include at least one auxiliary discharge port or opening 226, 227, 236, 237 formed below the first and second discharge port 222, 232 through which air introduced through the suction port 121 is discharged. The at least one auxiliary discharge port 226, 227, 236, 237 may include a first front discharge port 226 formed in the front side of the first tower 220, a first rear discharge port 227 (FIG. 3) formed in the rear side of the first tower 220 and spaced apart from the first front discharge port 226 in the front-rear direction, a second front discharge port 236 formed in the front side of the second tower 230, and a second rear discharge port 237 formed in the rear side of the second tower 230 and spaced apart from the second front discharge port 236.

A plurality of first front discharge ports 226 may be formed to be vertically spaced apart. A plurality of second front discharge ports 236 may be formed to be vertically spaced apart. The first front discharge port 226 and the second front discharge port 236 may face each other. The first front discharge port 226 may be formed in the first inner wall 221*e*, and the second front discharge port 236 may be formed in the second inner wall 231*e*. The first and second front discharge ports 226 and 236 may be provided at a rear of the first and second board slits 223 and 233.

A plurality of first rear discharge ports 227 may be formed to be vertically spaced apart. A plurality of second rear discharge ports 237 may be formed to be vertically spaced apart. The first rear discharge port 227 and the second rear discharge port 237 may face each other and be formed in the first inner wall 221*e* and the second inner wall 231*e*, respectively. The first rear discharge port 227 may be formed below the first discharge port 222, and the second rear discharge port 237 may be formed below the second discharge port 232.

A number of the first front discharge ports 226 may be less than a number of the first rear discharge ports 227. A vertical length or height of the first front discharge port 226 may be less than a vertical length or height of the first rear discharge port 227. A number of the second front discharge ports 236 may be less than a number of the second rear discharge ports 227. A vertical length or height of the second front discharge port 236 may be less than a vertical length or height of the second rear discharge port 237.

Hereinafter, an internal structure of the blower 1 will be described with reference to FIGS. 2 and 3. The blower 1 of FIGS. 2 and 3 may be in a state in which a closing and opening device 500 described later is removed. The opening and closing device 500 may alternatively be referred to as a vane or door assembly or as an auxiliary door device.

Figure 2:
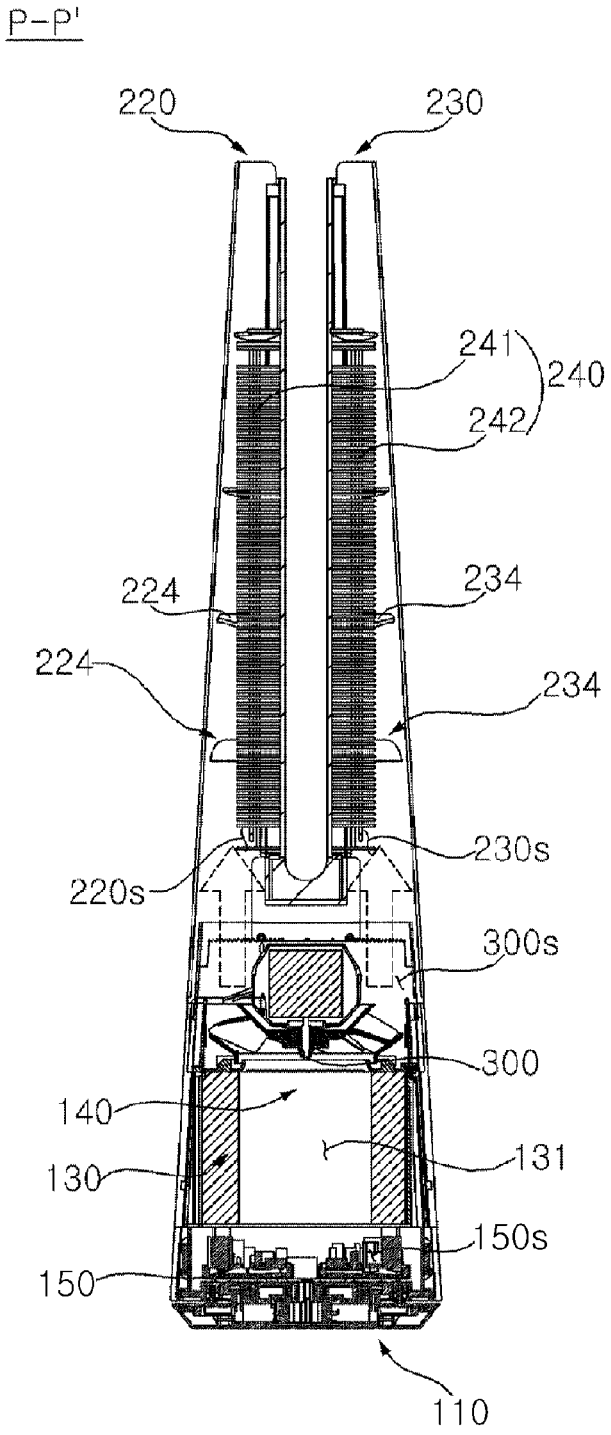
FIG. 2 is a longitudinal sectional perspective view taken along line P-P' of a blower according to an embodiment.

Referring to FIG. 2, a substrate assembly or controller 150 (e.g., printed circuit board or PCB assembly) to control an operation of a fan assembly 300 and a heater 240 may be provided in an upper side of the base 110. A control space 150S in which the substrate assembly 150 is provided may be formed in the upper side of the base 110.

The filter 130 may be provided above the control space 150S. The filter 130 may have a hollow cylindrical shape, and a cylindrical filter hole 131 or hollow opening may be formed inside the filter 130. Air introduced through the suction port 121 may pass through the filter 130 and flow to the filter hole 131.

A suction grill 140 may be provided above the filter 130. Air flowing upward through the filter 130 may pass through the suction grill 140. The suction grill 140 may be provided between the fan assembly 300 and the filter 130. When the lower case 210 is removed and the filter 130 is separated from the blower 1, the suction grill 140 may prevent a user's hand from contacting the fan assembly 300.

The fan assembly 300 may be provided in the upper side of the filter 130 and may generate a suction force for air outside the blower 1. By driving the fan assembly 300, ambient air outside the blower 1 may be suctioned through the suction port 121 and the filter hole 131 sequentially to flow to the first tower 220 and the second tower 230. A pressurizing space 300*s* in which the fan assembly 300 is provided may be formed between the filter 130 and the blowing module 200.

A first distribution space 220*s* may be formed inside the first tower 220, and a second distribution space 230*s* may be formed inside the second tower 230. Air that passes through the pressurizing space 300*s* may flow upward through the first or second distribution spaces 220*s* or 230*s*. The tower base 210 may distribute the air that passed through the pressurizing space 300*s* into the first distribution space 220*s* and the second distribution space 230*s*. The tower base 210 may form a channel connecting the first and second towers 220 and 230 and the fan assembly 300.

The first distribution space 220*s* may be formed between the first outer wall 221*d* and the first inner wall 221*e*. The second distribution space 230*s* may be formed between the second outer wall 231*d* and the second inner wall 231*e*.

The first tower 220 may include a first flow guide or air guide 224 that guides a flow direction of the air inside the first distribution space 220*s*. A plurality of first flow guides 224 may be provided to be spaced apart from each other vertically.

The first flow guide 224 may be formed to protrude from the first tower rear end 221*c* toward the first tower front end 221*b*. The first flow guide 224 may be spaced apart from the first tower front end 221*b* in the front-rear direction. The first flow guide 224 may extend obliquely downward while progressing toward the front. An angle at which each of the plurality of first flow guides 224 is inclined downward may decrease as the first flow guide 224 progresses upward.

The second tower 230 may include a second flow guide or air guide 234 that guides a flow direction of the air inside the second distribution space 230*s*. A plurality of second flow guides 234 may be provided to be spaced apart from each other vertically.

The second flow guide 234 may be formed to protrude from the second tower rear end 231*c* toward the second tower front end 231*b*. The second flow guide 234 may be spaced apart from the second tower front end 231*b* in the front-rear direction. The second flow guide 234 may extend obliquely downward while progressing toward the front. An angle at which each of the plurality of second flow guides 234 is inclined downward may decrease as the second flow guide 234 progresses upward.

The first flow guide 224 may guide the air discharged from the fan assembly 300 to flow toward the first discharge port 222. The second flow guide 234 may guide the air discharged from the fan assembly 300 to flow toward the second discharge port 232.

Figure 3:
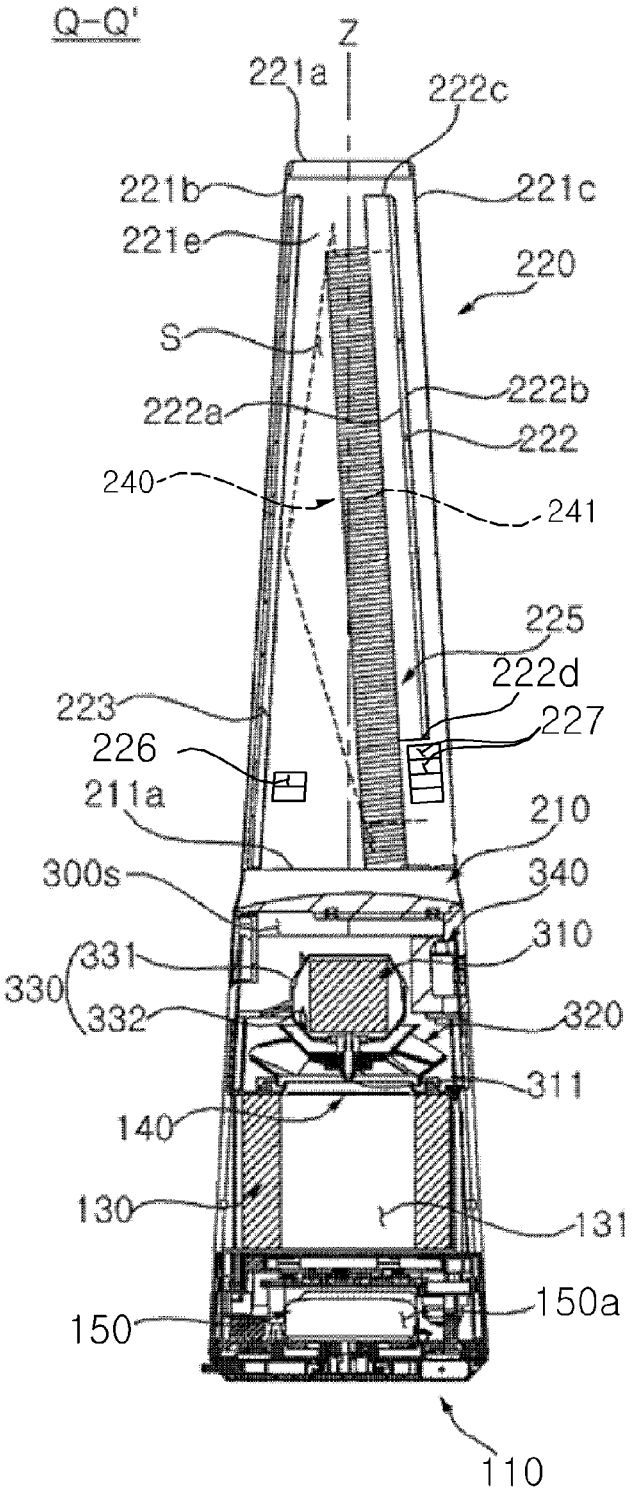
FIG. 3 is a longitudinal sectional perspective view taken along line Q-Q' of a blower according to an embodiment.

Referring to FIG. 3, the fan assembly 300 may include a fan motor 310 which generates power, a motor housing 330 which receives the fan motor 310, a fan 320 which is rotated by receiving power from the fan motor 310, and a diffuser 340 which guides the flow direction of the air pressurized by the fan 320.

The fan motor 310 may be provided at an upper side of the fan 320 and may be connected to the fan 320 through a motor shaft 311 extending downward from the fan motor 310. The motor housing 330 may include a first or upper motor housing 331 covering an upper portion of the fan motor 310 and a second or lower motor housing 332 covering a lower portion of the fan motor 310.

The first discharge port 222 may be provided in the upper side of the tower base 210. A first discharge port lower end 222*d* may join with or be provided in the upper side of the tower base upper surface 211.

The first discharge port 222 may spaced apart from the lower side of the first tower upper end 221*a*. A first discharge port upper end 222*c* may be formed to be spaced apart from the lower side of the first tower upper end 221*a*.

The first discharge port 222 may obliquely extend in the vertical direction to be inclined. The first discharge port 222 may be inclined forward while progressing upward. The first discharge port 222 may obliquely extend rearward with respect to a vertical axis Z extending in the vertical direction.

A first discharge port front end 222*a* and a first discharge port rear end 222*b* may extend obliquely in the vertical direction, and may extend parallel to each other. The first discharge port front end 222*a* and the first discharge port rear end 222*b* may be inclined rearward with respect to the vertical axis Z extending in the vertical direction.

The first tower 220 may include a first discharge guide 225 to guide the air inside the first distribution space 220*s* to the first discharge port 222. The first tower 220 may be symmetrical with the second tower 230 with respect to the blowing space S, and may have the same shape and structure as the second tower 230. The description of the first tower 220 described above may be identically applied to the second tower 230.

The blower 1 may include a heater 240 provided inside the upper case. A plurality of heaters 240 may be provided to correspond to the first discharge port 222 and the second discharge port 232, respectively. The heater 240 may include a first heater 241 provided in the first tower 220 and a second heater 242 provided in the second tower 230. The first heater 241 may be provided obliquely or at an angle in the vertical direction to correspond to or align with the first discharge port 222, and the second heater 242 may be provided obliquely or at an angle in the vertical direction to correspond to or align with the second discharge port 232.

The heater 240 may be supplied with power by a power supply device based on a switched mode power supply (SMPS) method. The heater 240 may receive power from an external power source and heat the air discharged to the blowing space S through the discharge port 222, 232. The heater 240 may be extended vertically to correspond to the auxiliary discharge ports 226, 227, 236, 237 and may heat the air discharged to the blowing space S through the auxiliary discharge port 226, 227, 236, 237.

Figure 4:
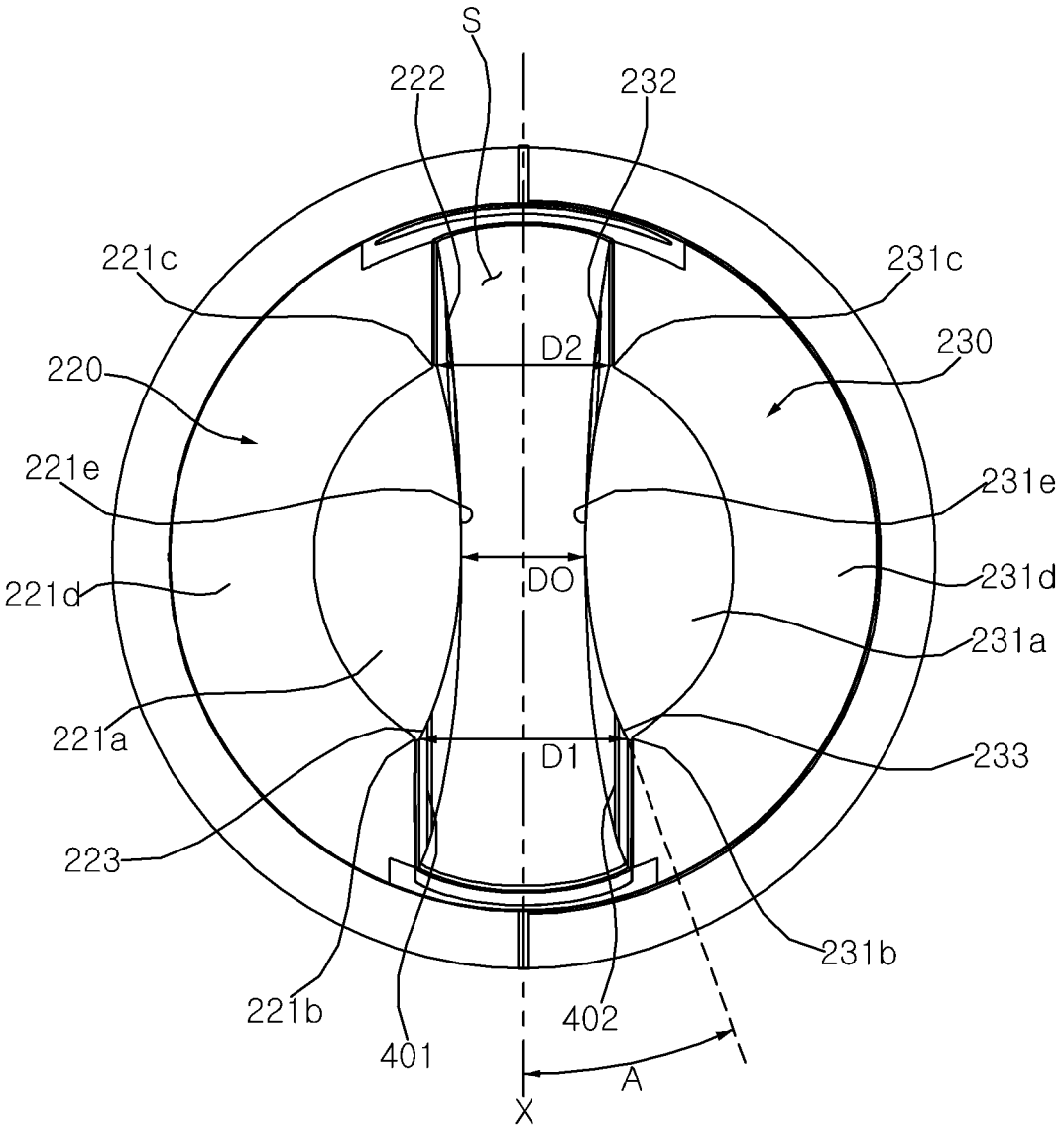
FIG. 4 is a top perspective view of a blower according to an embodiment.

Hereinafter, an air discharge structure of the blower 1 for inducing a Coanda effect will be described with reference to FIGS. 4 and 5. Referring to FIG. 4, due to the convex curvatures of the first and second inner walls 221*e* and 231, a distance between the first inner wall 221*e* and the second inner wall 231*e* may decrease while approaching a closer of the blowing space S.

The first inner wall 221*e* and the second inner wall 231*e* may be formed to be convex toward the radial inner side, and a shortest or center distance D0 may be formed between the vertices or centers of the first inner wall 221*e* and the second inner wall 231*e*. The shortest distance D0 may be formed in the center of the blowing space S.

The first and second discharge ports 222 and 232 may be formed behind a position where the shortest distance D0 is formed. The first tower front end 221*b* and the second tower front end 231*b* may be spaced apart by a first or front distance D1. The first tower rear end 221*c* and the second tower rear end 231*c* may be spaced apart by a second or rear distance D2.

The first distance D1 and the second distance D2 may be the same, but embodiments disclosed herein are not limited. The first distance D1 may be greater than the shortest distance D0, and the second distance D2 may be greater than the shortest distance D0.

The distance between the first inner wall 221*e* and the second inner wall 231*e* may be decreased from the rear ends 221*c*, 231*c* to a position where the shortest distance D0 is formed, and may be increased from a position where the shortest distance D0 is formed to the front ends 221*b*, 231*b*.

The first tower front end 221*b* and the second tower front end 231*b* may be formed to be inclined or curved with respect to a front-rear axis X. Tangent lines drawn at each of the first and second tower front ends 221*b* and 231*b* may have a certain inclination angle A with respect to the front-rear axis X.

Some of the air discharged forward through the blowing space S may flow with the inclination angle A with respect to the front-rear axis X. Due to this curved structure of the first and second inner walls 221*e* and 231*e*, the diffusion angle of the air discharged forward through the blowing space S may be increased.

A first airflow converter 401 described later may be brought into the first board slit 223 when air is discharged forward through the blowing space S. A second airflow converter 402 described later may be brought into the second board slit 233 when air is discharged forward through the blowing space S.

Figure 5:
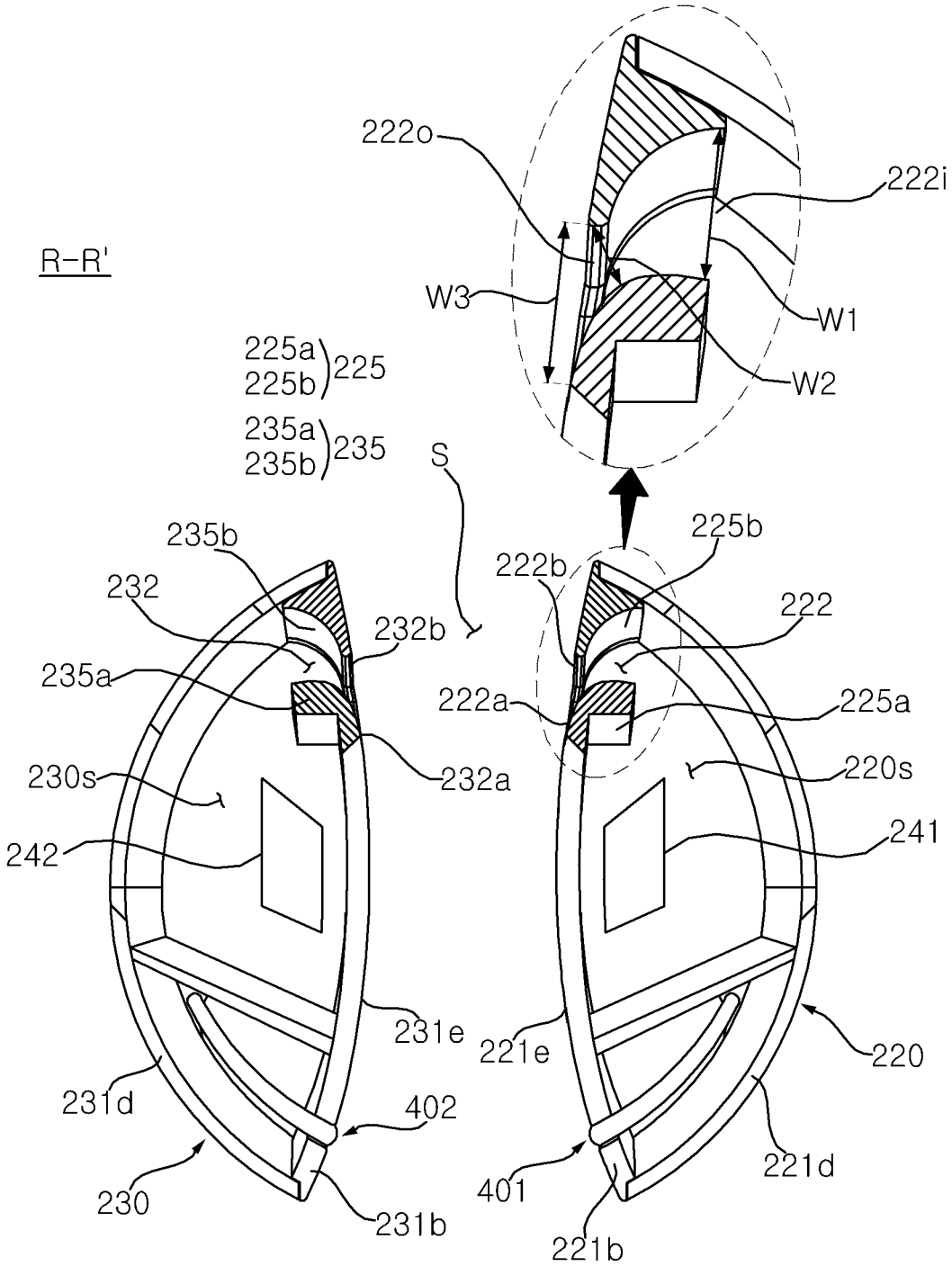
FIG. 5 is a cross-sectional perspective view taken along line R-R' of a blower according to an embodiment.

Referring to FIG. 5, air discharged toward the blowing space S may be guided in a flow direction by the first discharge guide 225 and the second discharge guide 235. The first discharge guide 225 may include a first inner guide 225*a* connected to the first inner wall 221*e* and a first outer guide 225*b* connected to the first outer wall 221*d*.

The first inner guide 225*a* may be manufactured integrally with the first inner wall 221*e*, or alternatively may be manufactured separately and later combined. The first outer guide 225*b* may be manufactured integrally with the first outer wall 221*d*, or alternatively may be manufactured separately and later combined.

The first inner guide 225*a* may be formed to protrude from the first inner wall 221*e* toward the first distribution space 220*s*. The first outer guide 225*b* may be formed to protrude from the first outer wall 221*d* toward the first distribution space 220*s*. The first outer guide 225*b* may be formed to be spaced apart from the first inner guide 225*a* and may form the first discharge port 222 between the first inner guide 225*a* and the first outer guide 225*b*.

A radius of curvature of the first inner guide 225*a* may be less than a radius of curvature of the first outer guide 225*b*. The air in the first distribution space 220*s* may flow between the first inner guide 225*a* and the first outer guide 225*b*, and may flow into the blowing space S through the first discharge port 222.

The second discharge guide 235 may include a second inner guide 235*a* connected to the second inner wall 231*e* and a second outer guide 235*b* connected to the second outer wall 231*d*. The second inner guide 235*a* may be manufactured integrally with the second inner wall 231*e*, or alternatively may be manufactured separately and later combined. The second outer guide 235*b* may be manufactured integrally with the second outer wall 231*d*, or alternatively may be manufactured separately and later combined.

The second inner guide 235*a* may be formed to protrude from the second inner wall 231*e* toward the second distribution space 230*s*. The second outer guide 235*b* may be formed to protrude from the second outer wall 231*d* toward the second distribution space 230*s*. The second outer guide 235*b* may be formed to be spaced apart from the second inner guide 235*a* and may form a second discharge port 232 between the second inner guide 235*a* and the second outer guide 235*b*.

A radius of curvature of the second inner guide 235*a* may be smaller than a radius of curvature of the second outer guide 235*b*. The air in the second distribution space 230*s* may flow between the second inner guide 235*a* and the second outer guide 235*b* and flow into the blowing space S through the second discharge port 232.

A width of the first discharge port 222 may be formed to gradually decrease and then increase as it progresses from an inlet of the first discharge guide 225, which may be an inlet 222*i* of the first discharge port 222, toward an outlet of the first discharge guide 226, which may be an outlet 222*o* of the first discharge port 222. An inlet width w1 of the inlet 222*i* may be larger than an outlet width w3 of the outlet 222*o*. The inlet width w1 may be defined as a distance between an outer end of the first inner guide 225*a* and an outer end of the first outer guide 225*b*. The outlet width w3 may be defined as a distance between the first discharge port front end 222*a*, which is an inner end of the first inner guide 225*a*, and the first discharge port rear end 222*b*, which is an inner end of the first outer guide 225*b*.

The inlet width w1 and the outlet width w3 may each be larger than a shortest or inner width w2 of the first discharge port 222. The shortest width w2 may be defined as the shortest distance between the first discharge port rear end 222*b* and the first inner guide 225*a*. The width of the first discharge port 222 may gradually decrease from the inlet of the first discharge guide 225 to a position where the shortest width w2 is formed, and may gradually increase from a position where the shortest width w2 is formed to the outlet of the first discharge guide 225.

Similar to the first discharge guide 225, the second discharge guide 235 may have a second discharge port front end 232*a* and a second discharge port rear end 232*b*. The second discharge guide 235 may have a same width distribution or configuration as the first discharge guide 225.

The air discharged to the blowing space S through the first discharge port 222 may flow forward along an inner surface of the first inner wall 221*e* due to the Coanda effect. The air discharged to the blowing space S through the second discharge port 232 may flow forward along an inner surface of the second inner wall 231*e* due to the Coanda effect.

Figure 6:
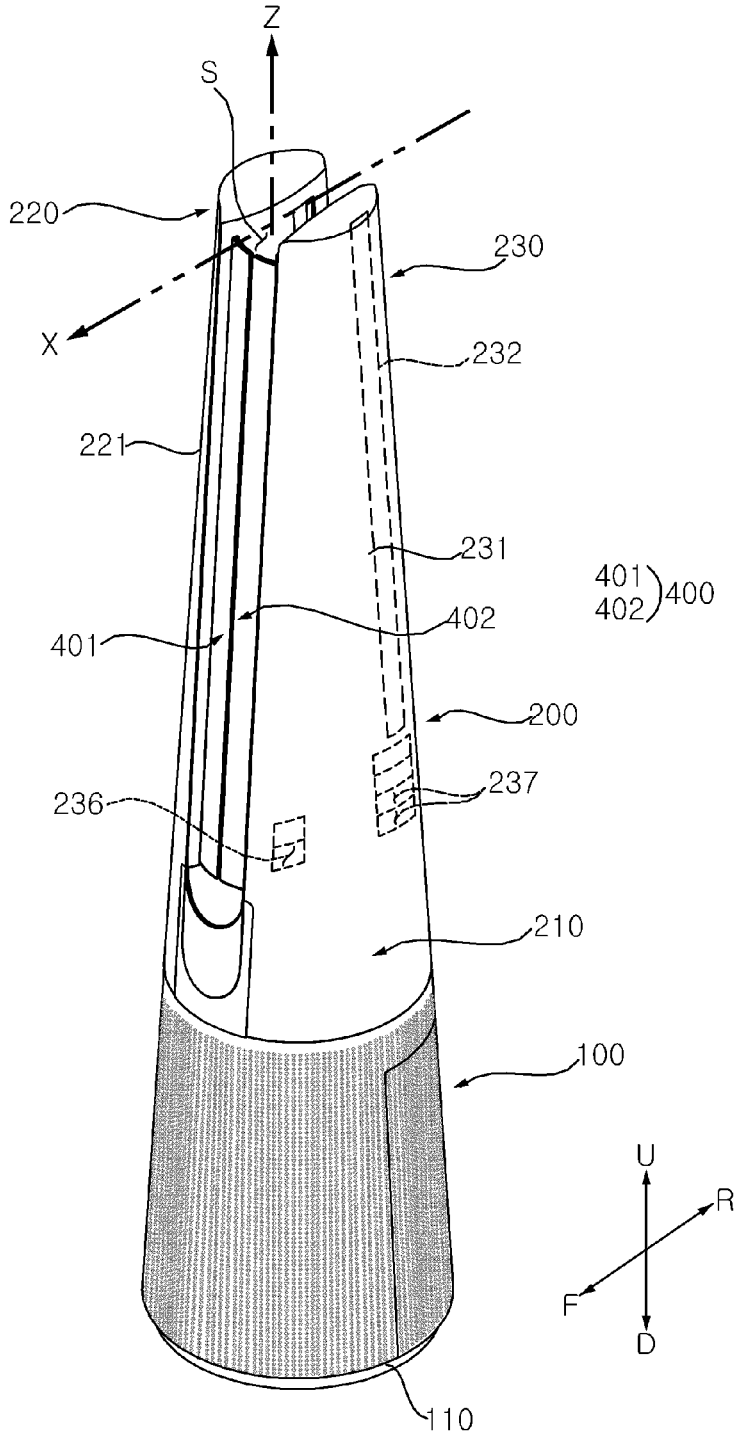
FIG. 6 is a diagram illustrating a state in which an air flow converter according to an embodiment is operated.

Hereinafter, a wind direction change by an air flow converter 400 will be described with reference to FIGS. 6 and 7. Referring to FIG. 6, the airflow converter 400 may protrude toward the blowing space S and may convert the flow of air discharged forward through the blowing space S into a rising wind.

The airflow converter 400 may include a first airflow converter 401 provided at the first tower case 221 and a second airflow converter 402 provided at the second tower case 231. The first airflow converter 401 and the second airflow converter 402 be coupled to (e.g., inserted in) and protrude from each of the first tower 220 and the second tower 230 toward the blowing space S to block a front of the blowing space S.

When the first airflow converter 401 and the second airflow converter 402 protrude to block the front of the blowing space S, the air discharged through the first discharge port 222 and the second discharge port 232 may flow upward in the Z direction. Air introduced through the suction port 121 may be discharged upward through the auxiliary discharge ports 226, 227, 236, 237. The closing and opening device 500 described later may guide the flow direction so that air discharged through the auxiliary discharge ports 226, 227, 236, 237 forms an upward airflow. The air discharged through the auxiliary discharge port 226, 227, 236, 237 may be joined with the air discharged through the first and second discharge ports 222, 232 to reinforce the upward airflow.

The first and second airflow converters 401 and 402 may be configured be inserted or pulled to an inside of the first and second towers 220 and 230, respectively, via the first and second board slits 223 and 233. When the first airflow converter 401 and the second airflow converter 402 are respectively brought or pulled into the first tower 220 and the second tower 230 to open the front of the blowing space S, the air discharged through the first discharge port 222 and the second discharge port 232 may flow forward X through the blowing space S. As an alternative, the first and second airflow converts 401 and 402 may be configured to be removable from the first and second board slits 223 and 233 (e.g., by lifting or pulling). As another alternative, the first and second air flow converters 401 and 402 may be removably coupled to the inner walls 221*e* and 231*e* of the first and second tower cases 221 and 231.

Figure 7:
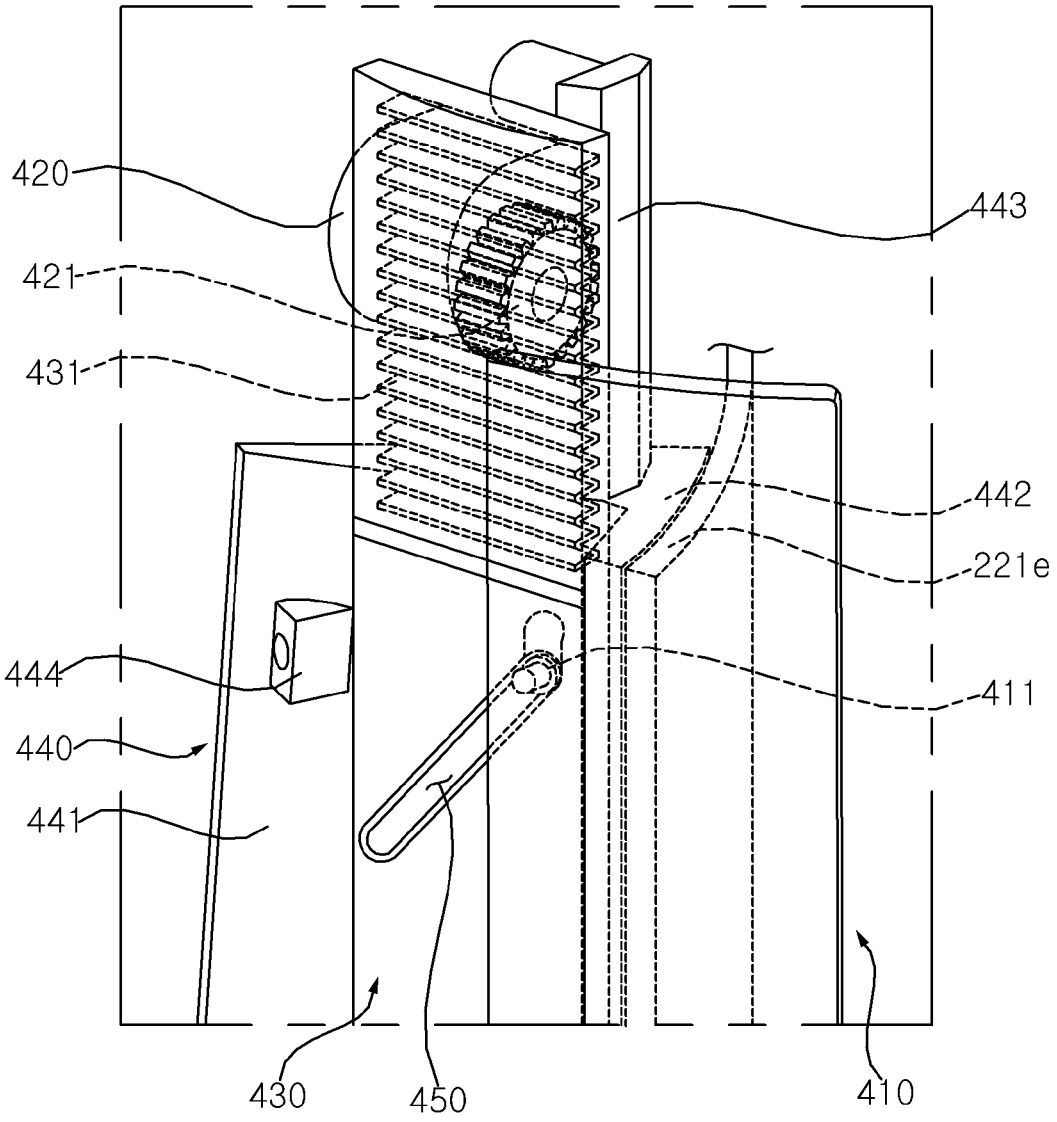
FIG. 7 is a diagram illustrating a driving principle of an airflow converter according to an embodiment.

Referring to FIG. 7, the first and second airflow converters 401 and 402 may each include a board 410 protruding toward the blowing space S, a motor 420 providing driving force to the board 410 to move the board 410, a board guide 430 to guide a moving direction of the board 410, and a cover 440 to support the motor 410 and the board guide 430. Hereinafter, the first airflow converter 401 will be described as an example, but the description of the first airflow converter 401 described below may be identically applied to the second airflow converter 402.

The board 410 may be brought into the first board slit 223 as shown in FIGS. 4 and 5. When the motor 420 is driven, the board 410 may protrude into the blowing space S through the first board slit 223. The board 410 may be curved to have an arc shape. When the motor 420 is driven, the board 410 may be moved in a curved or circumferential direction to protrude into the blowing space S.

The motor 420 may be connected to a pinion gear 421 to rotate the pinion gear 421. The motor 420 may rotate the pinion gear 421 clockwise or counterclockwise.

The board guide 430 may have a plate shape extending vertically. The board guide 430 may include a guide slit 450 which is inclined upward in a rightward direction (or alternatively, leftward direction), based on FIG. 7. The board guide may include a rack 431 formed to protrude toward and engage with the pinion gear 421. When the motor 420 is driven and the pinion gear 421 is rotated, the rack 431 engaged with the pinion gear 421 may be moved vertically.

A guide protrusion or knob 411 may be formed in the board 410 to protrude toward the board guide 430. The guide protrusion 411 may be inserted into the guide slit 450. When the board guide 430 is moved vertically according to the vertical movement of the rack 431, the guide protrusion 411 may be moved by an edge of the board guide 430 defining the guide slit 450 pressing against the guide protrusion 411. According to the vertical movement of the board guide 430, the guide protrusion 411 may be moved diagonally within the guide slit 450.

When the rack 431 is moved upward, the guide protrusion 411 may be moved along the guide slit 450 to be positioned in a lowermost end (also a leftmost end in FIG. 7) of the guide slit 450. When the guide protrusion 411 is positioned in the lowermost end of the guide slit 450, the board 410 may be completely concealed within the first tower 220 as shown in FIGS. 4 and 5. When the rack 431 is moved upward, the guide slit 450 is also moved upward. Accordingly, the guide protrusion 411 may be moved in the circumferential direction on a same horizontal plane along the guide slit 450.

When the rack 431 is moved downward, the guide protrusion 411 may be moved along the guide slit 450 to be positioned in an uppermost end (also a rightmost end in FIG. 7) of the guide slit 450. When the guide protrusion 411 is positioned in the uppermost end of the guide slit 450, the board 410 may protrude from the first tower 220 toward the blowing space S as shown in FIG. 6. When the rack 431 is moved downward, the guide slit 450 is also moved downward. Accordingly, the guide protrusion 411 may be moved in the circumferential direction on the same horizontal plane along the guide slit 450.

The cover 440 may include a first cover 441 provided outside the board guide 430, a second cover 442 provided inside the board guide 430 and contacting the first inner surface 221*e*, a motor support plate 443 extended upward from the first cover 441 and connected to the motor 420, and a stopper 444 to limit the vertical movement of the board guide 430. The first cover 441 may cover an outside of the board guide 430, and the second cover 442 may cover an inside of the board guide 430. The first cover 441 may separate a space in which the board guide 430 is provided from the first distribution space 220*s*. The second cover 442 may prevent the board guide 430 from contacting the first inner wall 221*e*.

The motor support plate 443 may extend upward from the first cover 441 to support the load of the motor 420. The stopper 444 may be formed to protrude toward the board guide 430 from the first cover 441. A locking protrusion may be formed on a surface of the board guide 430, and the locking protrusion may be configured to be caught by the stopper 444 according to the vertical movement of the board guide 430. When the board guide 430 is moved vertically, the locking protrusion may be caught by the stopper 444 so that a vertical movement of the board guide 430 may be restricted.

Figure 8:
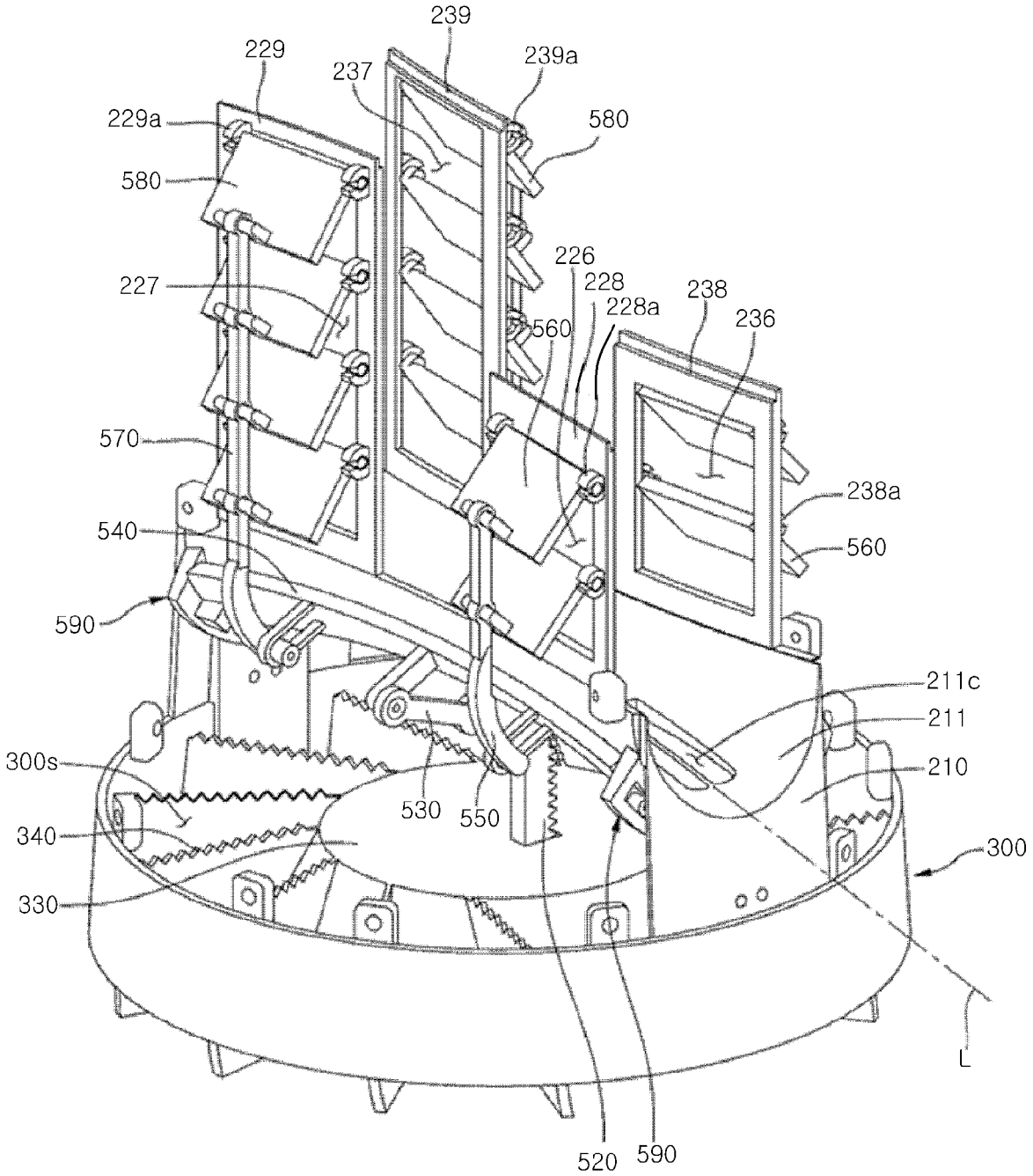
FIG. 8 is a view illustrating an installation structure of a closing and opening device according to an embodiment.
Figure 9:
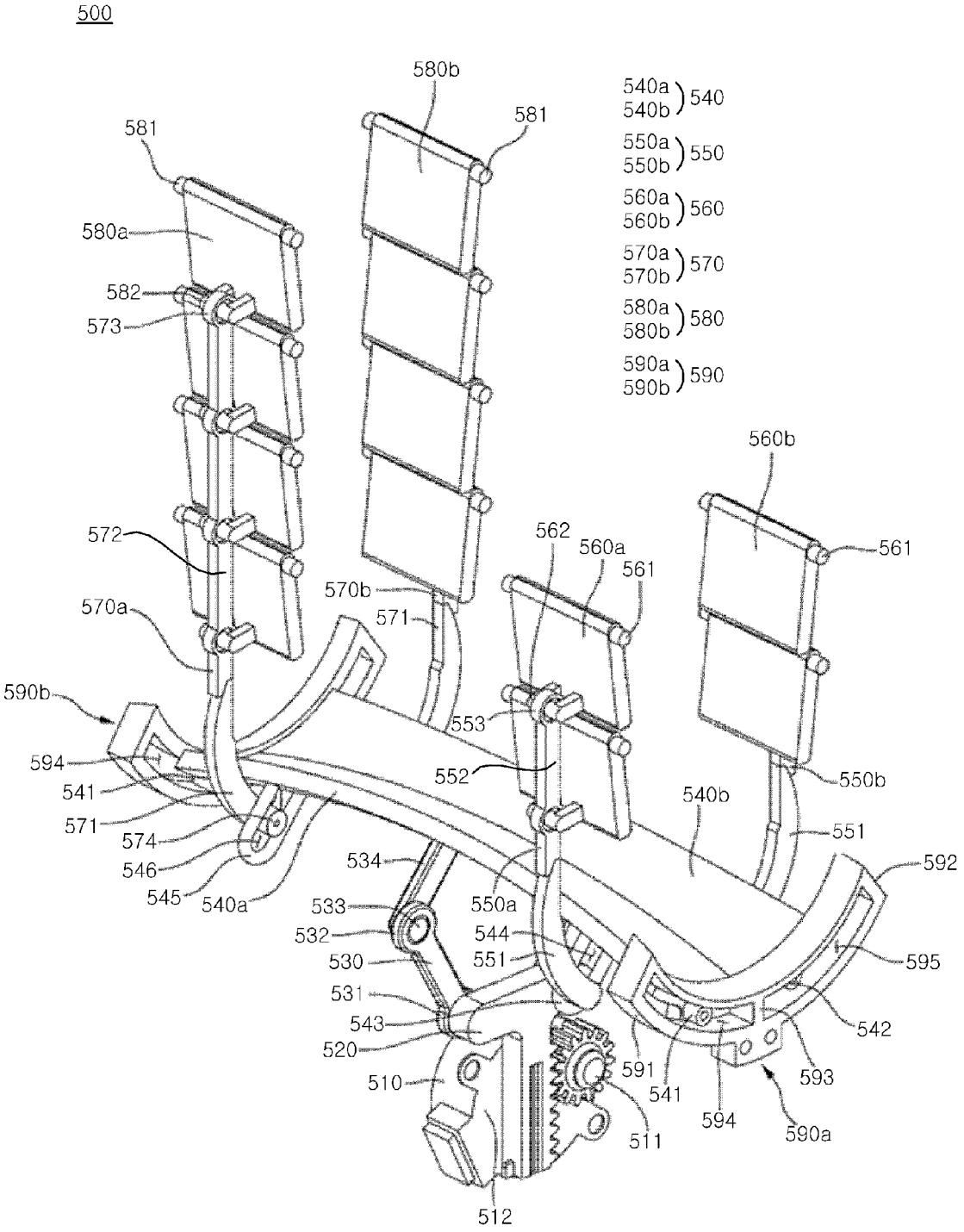
FIG. 9 is a perspective view of a closing and opening device according to an embodiment.
Figure 10:
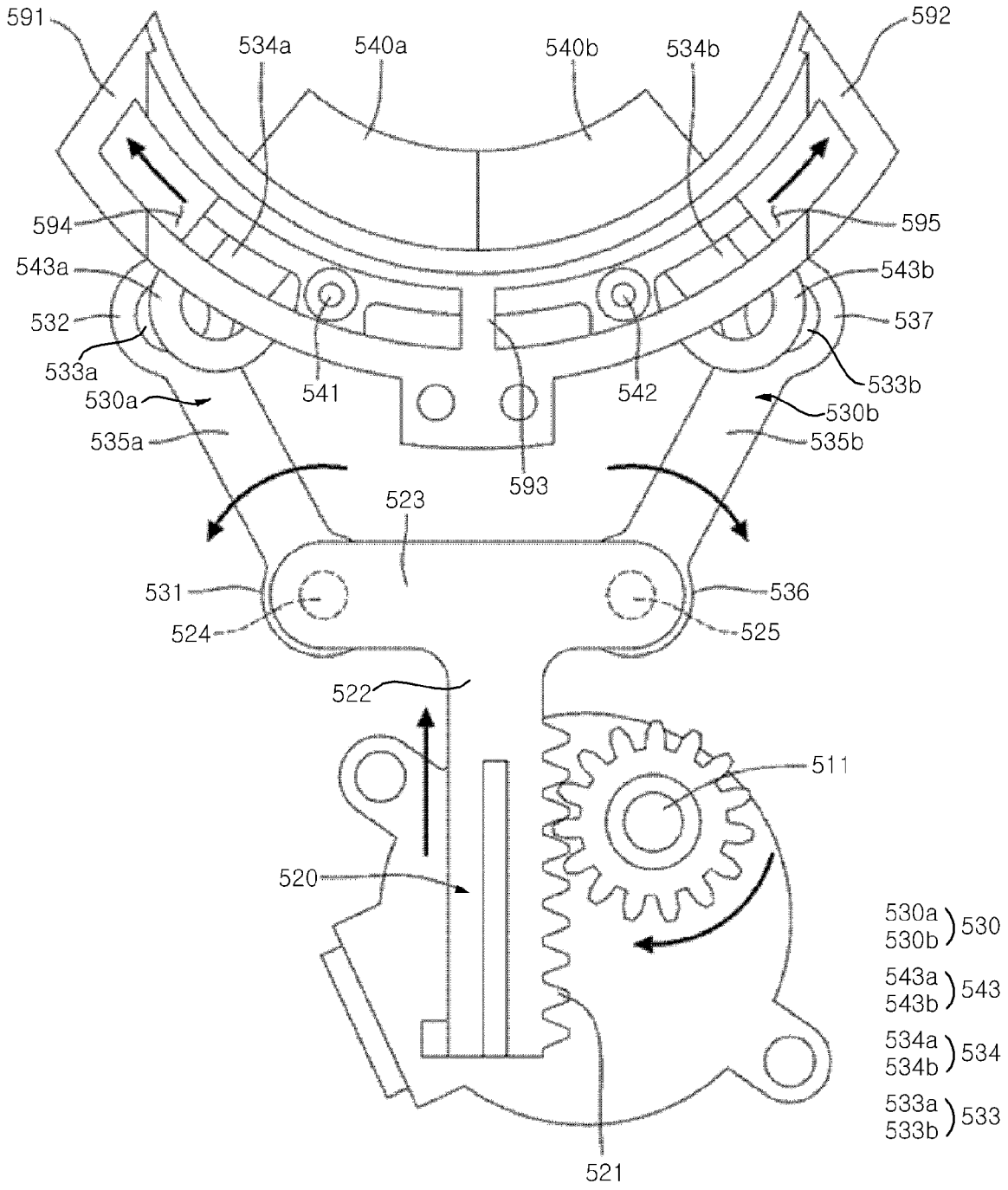
FIG. 10 is a front view of a closing and opening device according to an embodiment.
Figure 11:
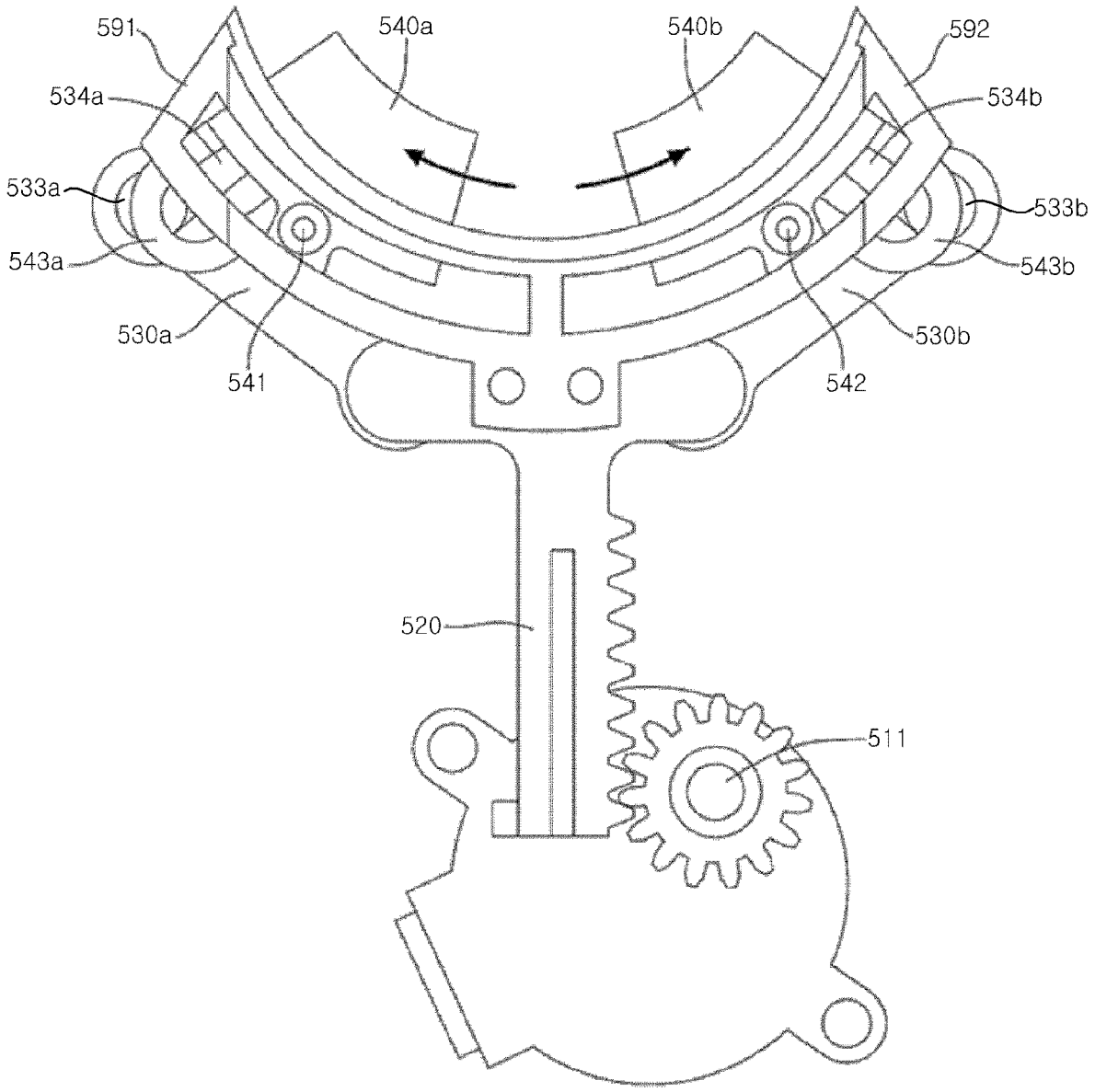
FIG. 11 is a diagram illustrating a state in which a closing and opening device according to an embodiment is driven.

Hereinafter, a structure of the closing and opening device 500 to open and close the auxiliary discharge ports 211*c*, 226, 227, 236, 237 will be described with reference to FIGS. 8 to 10. Referring to FIGS. 8-10, the first discharge port 222 and the second discharge port 232 described above may be collectively referred to as "main discharge port" 222, 232. The first and second discharge ports 222 and 232 may individually alternatively be referred to as first and second discharge openings 222 and 232. An operation mode in which air discharged through the main discharge port 222, 232 is mixed and supplied to the front may be defined as a "normal mode". The normal mode may be referred to as a first mode. The normal mode can be understood as a mode that directly supplies a comfortable airflow to a user positioned in front of the blower 1.

The plurality of auxiliary discharge ports 211*c*, 226, 227, 236, and 237 described above may further include a lower discharge port 211*c*, in addition to the previously described first and second front discharge ports 226 and 236 and first and second rear discharge ports 227 and 237. The plurality of auxiliary discharge ports 211*c*, 226, 227, 236, and 237 may discharge air upward in a sleep wind mode and induce a rising wind in the blowing space S.

The blower 1 according to an embodiment of the present disclosure may be driven in a normal mode in which a comfortable airflow is directly supplied to a user and in a sleep wind mode in which a comfortable airflow is not directly supplied to a user. The normal mode may alternatively be referred to as a first mode, and the sleep wind mode may be referred to as a second mode. A controller, which may be the same or different from substrate assembly 150, may be provided in the control space 150*s* to control a door motor 510 described later so that the auxiliary discharge ports 211*c*, 226, 227, 236, 237 may be opened and closed according to a mode selected by a user among the normal mode and the sleep wind mode.

When operating in the normal mode, air may be discharged through the main discharge port 222, 232 and mixed in the blowing space S to provide a discharge air flow to a user positioned at a front. During the normal mode, the plurality of auxiliary discharge ports 211*c*, 226, 227, 236, 237 may maintain a closed state.

When operating in the sleep wind mode, the air discharged through the main discharge port 222, 232 may be blocked by the air flow converter 400 and mixed with the air discharged through the auxiliary discharge ports 211*c*, 226, 227, 236, 237 in the blowing space S to form an upward airflow. In the sleep wind mode, the plurality of auxiliary discharge ports 211*c*, 226, 227, 236, 237 may be maintained open.

In the sleep wind mode, the air supplied from the blower 1 may rise along the blowing space S and may be diffused throughout the room to have a relatively small wind speed. The supplied air may provide a soft airflow to ensure a sleeping environment of a user.

A virtual line that passes through the center of the blowing space S and extends in the front-rear direction may be defined as a reference line L. The first tower 220 and the second tower 230 may be symmetrical with respect to the reference line L.

The first front discharge port 226 and the second front discharge port 236 may be face each other. The first front discharge port 226 and the second front discharge port 236 may be symmetrical with respect to the reference line L. Similarly, the first rear discharge port 227 and the second rear discharge port 237 may be face each other. The first rear discharge port 227 and the second rear discharge port 237 may be symmetrical with respect to the reference line L.

The tower base 210 may have the lower discharge port 211*c* to discharge the air blown from the fan assembly 300 upward. The lower discharge port 211*c* may be opened in a vertical direction on the tower base upper surface 211. The lower discharge port 211*c* may extend in the front-rear direction and discharge air toward the blowing space S formed in the upper side of the tower base 210. A plurality of lower discharge ports 211*c* may be formed to be spaced apart from each other in the width direction (or left-right direction) of the blowing space S. The air may be discharged obliquely upward through the plurality of auxiliary discharge ports 226, 227, 236, 237, and may be joined and mixed with the air discharged upward through the lower discharge port 211*c* in the blowing space S to form an upward airflow.

The closing and opening device 500 may include a plurality of upper doors or louvers 560 and 580 to open and/or close the plurality of auxiliary discharge ports 226, 227, 236, and 237. The closing and opening device 500 may include a plurality of lower doors or louvers 540 to open or close the lower discharge port 211*c*. Hereinafter, the upper door 560, 580 and the lower door 540 are collectively referred to as "door." The upper and lower doors 560 and 580 may alternatively be referred to as vanes. The closing and opening device 500 may alternatively be referred to as a door, louver, vane, or a door assembly.

The closing and opening device 500 may include a door motor 510 that provides power to move the door 540, 560, 580, a rack 520 connected to the door motor 510 that moves vertically, a connection link 530 connected to the rack 520, a lower door 540 connected to the connection link 530 and moved, a front slide link 550 that is connected to the lower door 540 and moved, a rear slide link 570 that is connected to the lower door 540 and moved, and a rotation guide 590 that guides the movement path of the lower door 540.

The upper doors 560 and 580 may include a front door 560 to open and close the first front discharge port 226 and the second front discharge port 236, and a rear door 580 to open and close the first rear discharge port 227 and the second rear discharge port 237. The front door 560 may be connected to the front slide link 550 and opened and closed, The rear door 580 may be connected to the rear slide link 570 and opened and closed.

A plurality of front doors 560 may be provided to correspond to each of the first front discharge port 226 and the second front discharge port 236. The plurality of front doors 560 may be symmetrical to each other with respect to the blowing space S and/or the reference line L.

A plurality of rear doors 580 may be provided to correspond to each of the first rear discharge port 227 and the second rear discharge port 237. The plurality of rear doors 580 may be symmetrical to each other with respect to the blowing space S and/or the reference line L.

The plurality of upper doors 560 and 580 may open and close the plurality of auxiliary discharge ports 226, 227, 236, and 237 simultaneously. The plurality of upper doors 560 and 580 may be rotated at once by receiving power from the door motor 510. The plurality of lower doors 540 may open and close the lower discharge ports 211*c* while the upper doors 560, 580 opens and closes the auxiliary discharge ports 226, 227, 236, 237. The plurality of lower doors 540 may open the lower discharge port 211*c* when the upper doors 560, 580 open the auxiliary discharge ports 226, 227, 236, 237, and close the lower discharge port 211*c* when the upper doors 560, 580 close the auxiliary discharge ports 226, 227, 236, 237.

A rotation center of each of the plurality of doors 540, 560, and 580 may be formed at different positions. Air discharged through the first front discharge port 226 and the second front discharge port 236 may be guided upward along a surface of the front door 560. Air discharged through the first rear discharge port 227 and the second rear discharge port 237 may be guided upward along a surface of the rear door 580.

The front door 560 and the rear door 580 may have a predetermined inclination angle or opening degree with respect to the vertical direction when the auxiliary discharge ports 226, 227, 236, 237 are opened. The predetermined inclination angle may be preset or predetermined so that the air discharged through the auxiliary discharge ports 226, 227, 236, 237 is directed to an upper portion of the blowing space S.

The front door 560 may have a first front door 560*a* that opens and closes the first front discharge port 226 and a second front door 560*b* that opens and closes the second front discharge port 236. The first front door 560*a* and the second front door 560*b* may be symmetrical with respect to the reference line L and the blowing space S.

The rear door 580 may have a first rear door 580*a* that opens and closes the first rear discharge port 227 and a second rear door 580*b* that opens and closes the second rear discharge port 237. The first rear door 580*a* and the second rear door 580*b* may be symmetrical with respect to the reference line L and the blowing space S.

A plurality of front doors 560*a*, 560*b* may be provided to correspond to each of a plurality of front discharge ports 226 and 236. The plurality of front doors 560*a*, 560*b* may be formed in multiple stages so that the plurality of front discharge ports 226 and 236 may be opened and closed simultaneously. A number of front doors 560*a*, 560*b* may equal a number of front discharge ports 225, 236.

A plurality of rear doors 580*a*, 580*b* may be provided to correspond to each of the plurality of rear discharge ports 227 and 237. The plurality of rear doors 580*a*, 580*b* may be in multiple stages so that the plurality of rear discharge ports 227 and 237 may be opened and closed simultaneously. A number of rear doors 580*a*, 580*b* may equal a number of front discharge ports 225, 236.

The front door 560 may include a front door rotation shaft 561 extending in the front-rear direction and a front link coupling part or loop 562 to which a front slide link 550 described later is coupled. The front coupling part 562 may form a loop that is inserted through or linked with a front link hole 553 of the slide link 550 described later. The front door rotation shaft 561 may protrude from the upper end of the front door 560 in the front-rear direction. The front door rotation shaft 561 may have a cylindrical shape. The front coupling part 562 may alternatively be referred to as a connector or connection link or loop. As an example, the front coupling part 562 may include a connection handle, staple, link, or loop, but embodiments disclosed herein are not limited.

The front door rotation shaft 561 may be rotatably coupled to a front frame 228, 238 formed in the tower case 221, 231. The front door rotation shaft 561 may be inserted into a front shaft fixing part 228*a*, 238*a* formed in the front frame 228, 238.

The first front frame 228 may be a part of the first tower case 221 and may form the first front discharge port 226. A first front shaft fixing part 228*a* may be formed in the first front frame 228, and the front door rotation shaft 561 of the first front door 560*a* may be rotatably coupled. The second front frame 238 may be a part of the second tower case 231 and may form the second front discharge port 236. A second front shaft fixing part 238*a* may be formed in the second front frame 238, and the front door rotation shaft 561 of the second front door 560*b* may be rotatably coupled.

The first front frame 228 and the first rear frame 229 may be connected (e.g., integrally formed with) the first inner wall 221*e*. The second front frame 238 and the second rear frame 239 may be connected to (e.g. integrally formed with) the second inner wall 231*e*.

The front shaft fixing part 228*a*, 238*a* may protrude in a direction away from the blowing space S from a surface of the front frame 228, 238. The front shaft fixing part 228*a*, 238*a* may form a hole opened in the front-rear direction so that the front door shaft 561 may be rotatably inserted. As an example, a cross-section of the front shaft fixing part 228*a*, 238*a* may be formed in a 'C' shape.

The front link coupling part 562 may protrude in a direction away from the blowing space S from the lower end of the front door 560. The front link coupling part 562 may be coupled to the front slide link 550 so as to be rotated according to the movement of the front slide link 550. The front link coupling part 562 may be fixed through a front link hole 553 formed in the front slide link 550.

The rear door 580 may include a rear door rotation shaft 581 extending in the front-rear direction and a rear link coupling part 582 to which a rear slide link 570 described later is coupled. The rear door rotation shaft 581 may protrude from an upper end of the rear door 580 in the front-rear direction. The rear door rotation shaft 581 may have a cylindrical shape.

The rear door rotation shaft 581 may be rotatably coupled to the rear frame 229, 239 formed in the tower cases 221, 231. The rear door rotation shaft 581 may be inserted into the rear shaft fixing part 229*a*, 239*a* formed in the rear frame 229, 239.

The first rear frame 229 may be a part of the first tower case 221 and may form the first rear discharge port 227. The first rear shaft fixing part 229*a* may be formed in the first rear frame 229 so that the rear door rotation shaft 581 of the first rear door 580*a* may be rotatably coupled. The second rear frame 239 may be a part of the second tower case 231 and may form the second rear discharge port 237. The second rear shaft fixing part 239*a* may be formed in the second rear frame 239 so that the rear door rotation shaft 581 of the second rear door 580*b* may be rotatably coupled.

The rear shaft fixing part 229*a*, 239*a* may protrude in a direction away from the blowing space S from a surface of the rear frame 229, 239. The rear shaft fixing part 229*a*, 239*a* may form a hole opened in the front-rear direction so that the rear door shaft 581 may be rotatably inserted. For example, a cross-section of the rear shaft fixing part 229*a*, 239*a* may be formed in a 'C' shape.

The rear link coupling part 582 may protrude in a direction away from the blowing space S from the lower end of the rear door 580. The rear link coupling part 582 may be coupled to the rear slide link 570 so as to be rotated according to the movement of the rear slide link 570. The rear link coupling part 582 may be fixed through a rear link hole 573 formed in the rear slide link 570.

The first front frame 228 and the first rear frame 229 may be connected to (e.g. integrally formed with) the first inner wall 221*e*. The second front frame 238 and the second rear frame 239 may be connected to (e.g., integrally formed with) the second inner wall 231*e*.

The closing and opening device 500 may include a door motor 510 that applies power to rotate the plurality of doors 540, 560, and 580. The blower 1 according to an embodiment of the present disclosure may be provided with a single door motor 510, and a plurality of doors 540, 560, and 580 may be reciprocated by a single door motor 510. The door motor 510 may be a step motor having one degree of freedom.

The door motor 510 may be installed in the inner space of the motor housing 330. The door motor 510 may be supported by an accommodating or supporting bracket 512.

The closing and opening device 500 may be provided in an upper side of the fan assembly 300. The air flowing upward in the pressurizing space 300*s* by the diffuser 340 may be discharged to the blowing space S through the auxiliary discharge ports 226, 227, 236, 237, and 211*c*.

The closing and opening device 500 may include the lower door 540 to open and/or close the lower discharge port 211*c*. The lower door 540 may include a first lower door 540*a* connected to a first connection link 530*a* (FIG. 10) described later and a second lower door 540*b* connected to a second connection link 530*b* (FIG. 10) described later. The first lower door 540*a* and the second lower door 540*b* may be formed in a curved shape that is convex downward. The first lower door 540*a* and the second lower door 540*b* may have a same curvature as the tower base upper surface 211 and may have a 'C'-shaped cross section.

The first lower door 540*a* and the second lower door 540*b* may be symmetrical with respect to the reference line L. The first lower door 540*a* and the second lower door 540*b* may be closer to or separated from each other according to a movement of the connection link 530. The first lower door 540*a* and the second lower door 540*b* may be in close contact with each other according to a driving of the connection link 530 to close the lower discharge port 211*c*. The first lower door 540*a* and the second lower door 540*b* may be separated from each other according to the driving of the connection link 530 to open the lower discharge port 211*c*.

A motor gear 511 may be coupled to the rotation shaft of the door motor 510. The motor gear 511 may have a tooth or gear shape along a circumferential direction. The closing and opening device 500 may include a rack 520 connected to the door motor 510 to convert a rotational motion of the door motor 510 into a linear motion. The closing and opening device 500 may also include a connection link 530 rotatably coupled to the rack 520.

The rack 520 may have a plurality of teeth or a gear rack 521 (FIG. 10) configured to engage with the motor gear 511. The teeth 521 may be formed in the rack 520 in the vertical direction. The rack 520 may be moved vertically by a rotation of the motor gear 511, and the rack 520 may convert a rotational motion of the door motor 510 into a vertical motion.

A lower part of the rack 520 may be positioned in the inner space of the motor housing 330, and an upper portion of the rack 520 may be positioned in the upper side of the motor housing 330. A cross section of the rack 520 may have a 'T' shape.

The rack 520 may include a stem 522 having the plurality of teeth 521 and a loop or roof 523 extending in a transverse direction in the upper side of the stem 522. The stem 522 and the loop 523 may extend in perpendicular or crossing direction, and may be formed integrally. The roof 523 may include first and second rack joints 524 and 525 formed at both ends, respectively. the first and second rack joints 524 and 525 may protrude from the roof 523 to be rotatably inserted into the connection link 530.

The connection link 530 may include a first connection link 530*a* connected to the first lower door 540*a* and a second connection link 530*b* connected to the second lower door 540*b*. The first rack joint 524 may be connected to the first connection link 530*a* and the second rack joint 525 may be connected to the second connection link 530*b*.

The first connection link 530*a* and the second connection link 530*b* may be symmetrical with respect to the reference line L and the blowing space S. The first connection link 530*a* may transmit power transmitted from the door motor 510 to the first lower door 540*a*. The second connection link 530*b* may transmit the power transmitted from the door motor 510 to the second lower door 540*b*. The connection link 530 may be rotatably coupled to the rack 520 and move depending on the vertical movement of the rack 520 so that a rotational force to rotate the lower door 540 may be transmitted.

A first connection ring 531 may be formed in an end of the first connection link 530*a*. A second connection ring 536 may be formed in an end of the second connection link 530*b*. The first rack joint 524 may be inserted into the first connection ring 531, and the second rack joint 525 may be inserted into the second connection ring 536.

The first connection link 530*a* may include a first connection rod 535*a* extending upward from the first connection ring 531. A first joint ring 532 having an open hole may be formed in the upper side of the first connection rod 535*a*. The first connection rod 535*a* may connect the first connection ring 531 and the first joint ring 532, and the first connection ring 531 and the first joint ring 532 may be opposed to each other based on the first connection rod 535*a*.

The second connection link 530*b* may include a second connection rod 535*b* extending upward from the second connection ring 536. A second joint ring 537 having an open hole may be formed in the upper side of the second connection rod 535*b*. The second connection rod 535*b* may connect the second connection ring 536 and the second joint ring 537, and the second connection ring 536 and the second joint ring 537 may be opposed to each other based on the second connection rod 535*b*. The first and second joint rings 532, 537 may be collectively referred to as a joint ring 532, 537.

The first joint ring 532 may be connected to the first lower door 540*a*. The second joint ring 537 may be connected to the second lower door 540*b*. The connection link 530 may include a joint protrusion 533 inserted into the joint ring 532, 537 and a crank 534 connected to the lower door 540. The joint protrusion 533 may protrude from the crank 534 and be inserted into the joint ring 532, 537.

The crank 534 may include a first crank 534*a* connected to (e.g., fixed or integrally formed with) the first lower door 540*a* and a second crank 534*b* connected to (e.g., fixed or integrally formed with) the second lower door 540*b*. The joint protrusion 533 may include a first joint protrusion 533*a* protruding from the first crank 534*a* and a second joint protrusion 533*b* protruding from the second crank 534*b*. The first joint protrusion 533*a* may protrude in a direction crossing the first crank 534*a* and may be rotatably inserted into the first joint ring 532. The second joint protrusion 533*b* may protrude in a direction crossing the second crank 534*b* and may be rotatably inserted into the second joint ring 537.

The first crank 534*a* may be included in the first connection link 530*a* and may transmit the power that the first connection link 530*a* received from the door motor 510 to the first lower door 540*a*. The first crank 534*a* may rotate about the first joint protrusion 533*a* to rotate the first lower door 540*a*.

The second crank 534*b* may be included in the second connection link 530*b* and may transmit the power that the second connection link 530*b* received from the door motor 510 to the second lower door 540*b*. The second crank 534*b* may rotate about the second joint protrusion 533*b* to rotate the second lower door 540*b*.

The rotation trajectory of the lower door 540 may be different from the rotation trajectory of the front door 560 and the rear door 580. The lower door 540 may be rotated along the tower base upper surface 211. The closing and opening device 500 may include front and rear slide guides 543 and 545 that transmit power to the front door 560 and the rear door 580.

The front and rear slide guides 543 and 545 may collectively be referred to as a slide guide 543, 545. The slide guide 543, 545 may extend downward from the lower door 540. The slide guide 543, 545 may extend obliquely in a direction away from the blowing space S from the lower door 540. The slide guide 543, 545 may include a front slide guide 543 that transmits power to the front door 560 and a rear slide guide 545 that transmits power to the rear door 580. The front slide guide 543 may include a first front slide guide 543*a* extending downward from the first lower door 540*a* and a second front slide guide 543*b* extending downward from the second lower door 540*b*. The front slide guide 543 may be spaced apart in front of the crank 534. The rear slide guide 545 may be spaced apart from the rear of the crank 534.

The closing and opening device 500 may include a front slide link 550 and a rear slide link 570. The front slide link 550 may be connected to the front door 560 to transmit power to the front door 560, and the rear slide link 570 may be connected to the rear door 580 to transmit power to the rear door 580.

The front slide link 550 may include a first front slide link 550*a* that transmits power to the first front door 560*a* and a second front slide link 550*b* that transmits power to the second front door 560*b*. The rear slide link 570 may include a first rear slide link 570*a* that transmits power to the first rear door 580*a* and a second rear slide link 570*b* that transmits power to the second rear door 580*b*.

The front slide link 550 may be coupled to the front link coupling part 562 of the front door 560. The rear slide link 570 may be coupled to the rear link coupling part 582 of the rear door 580. The front slide guide 543 may have a front guide hole or slot 544 that is opened along an extension direction of the front slide guide 543. The front guide hole 544 may be a space inclined from the lower side of the lower door 540 in a direction away from the blowing space S. The rear slide guide 545 may have a rear guide hole 546 that is opened along an extension direction of the rear slide guide 545. The rear guide hole 546 may be a space inclined in a direction away from the blowing space S from the lower side of the lower door 540.

The front slide link 550 and the rear slide link 570 may collectively be referred to as a slide link 550, 570. A guide protrusion 574 protruding from the slide link 550, 570 may be inserted into the front guide hole 544 and the rear guide hole 546. The guide protrusion 574 may be inserted into each of the front guide hole 544 and the rear guide hole 546 and may be moved inside the slide guide 543, 545.

The closing and opening device 500 may include a rotation guide 590 that guides the movement of the lower door 540. The rotation guide 590 may include a front rotation guide 590*a* to guide a movement of the front side of the lower door 540 and a rear rotation guide 590*b* for to guide a movement of the rear side of the lower door 540. The rotation guide 590 may be provided in the front and rear sides of the lower door 540, respectively.

The rotation guide 590 may have a first rotation guide 591 to guide a movement of the first lower door 540*a* and a second rotation guide 592 to guide a movement of the second lower door 540*b*. The first rotation guide 591 and the second rotation guide 592 may be included in each of the front rotation guide 590*a* and the rear rotation guide 590*b*.

The first rotation guide 591 and the second rotation guide 592 may be separated from each other by a partition wall 593. The partition wall 593 may be formed parallel to the reference line L, and the first rotation guide 591 and the second rotation guide 592 may be symmetrical with respect to the partition wall 593.

First and second door pins 541 and 542 may be formed in front and rear ends of the lower door 540, respectively. The first and second door pins 541 and 542 may be inserted into the rotation guide 590.

The first and second door pins 541 and 542 may protrude forward from the front end of the lower door 540 and may protrude rearward from the rear end of the lower door 540.

The first door pin 541 may protrude from the first lower door 540*a* and the second door pin 542 may protrude from the second lower door 540*b*.

The rotation guide 590 may have first and second rotation spaces 594 and 595 that provide paths through which the first and second door pins 541 and 542 can move. The first rotation space 594 may be formed in the first rotation guide 591 and the second rotation space 595 may be formed in the second rotation guide 592. The first rotation space 594 and the second rotation space 595 may be symmetrical with respect to the partition wall 593.

The first rotation space 594 may be formed in an arc shape and may have the same curvature as the tower base upper surface 211. The second rotation space 595 may be formed in an arc shape and may have the same curvature as the tower base upper surface 211. The first door pin 541 may be moved within the first rotation space 594 and the second door pin 542 may be moved within the second rotation space 595.

The rack 520 and the lower door 540 may have a connection relationship of a slider-crack mechanism. The rack 520 may serve as a slider and the lower door 540 may serve as a crank.

When the rack 520 moves upward, two connection links 530*a* and 530*b* coupled to both sides of the roof 523 of the rack 520 may rotate outward (as indicated by the arrows in FIG. 10), and the crank 534 of the connection link 530 may rotate outward (as indicated by the arrows in FIG. 10) while rotating the lower door 540. The lower discharge port 211*c* may be opened, and air discharged upward through the pressurizing space 300*s* may be discharged toward the blowing space S through the lower discharge port 211*c*.

The front door 560 may be rotated according to the movement of the front slide link 550, and the rear door 580 may be rotated according to the movement of the rear slide link 570. The guide protrusion 574 and may have a rear guide protrusion (indicated by 574 in FIG. 9) and a front guide protrusion. The rear slide link 570 may have the rear guide protrusion 574, which may be inserted into the rear guide hole 546 to move along the rear guide hole 546. The front slide link 550, like the rear slide link 570, may have the front guide protrusion, which may be inserted into the front guide hole 544 to move along the front guide hole 544. The guide protrusion 574 of the rear slide link 570 and the guide protrusion of the front slide link 550 may receive a force from the rear and front slide guides 545 and 543, respectively, and moved by the rotation of the lower door 540 so that the rear and front slide links 570, 550 may be rotated or moved.

The front slide link 550 may include a front bent portion or bend 551 that has the front guide protrusion and extends obliquely upward, and a front extension 552 extending upward from the front bend 551. The guide protrusion may protrude from the lower end of the front bend 551, and the front link hole 553 may be formed in the upper end of the front extension 552.

The rear slide link 570 may include a rear bend 571 that has the rear guide protrusion 574 and extends obliquely upward, and a rear extension 572 extending upward from the rear bend 571. The rear guide protrusion 574 may protrude from the lower end of the rear bend 571, and the rear link hole 573 may be formed in the upper end of the rear extension 572.

A plurality of front link holes 553 may be formed to correspond to the number of front doors 560. The plurality of front link holes 553 may be spaced apart from each other along an extension direction of the front extension 552. A plurality of front link coupling parts 562 may pass through the plurality of front link holes 553.

A plurality of rear link holes 573 may be formed to correspond to the number of rear doors 580. The plurality of rear link holes 573 may be spaced apart from each other along an extension direction of the rear extension 572. A plurality of rear link coupling parts 582 may pass through the plurality of rear link holes 573.

Hereinafter, an operation principle by which the auxiliary discharge ports 226, 227, 236, 237, 211*c* are opened and closed by the closing and opening device 500 will be described with reference to FIGS. 8 to 12.

When the rack 520 moves upward according to an operation of the door motor 510, the first and second connection links 530*a* and 530*b* coupled to both sides of the roof 523 may be rotated outward (as indicated by the arrows). An operation of the door motor 510 may be controlled by the controller provided in the control space 150*s*.

Thereafter, the crank 534 of the connection link 530 may rotate the lower door 540 while being opened outward according to the movement of the connection link 530. A rotation direction or movement trajectory of the lower door 540 may be guided by the rotation guide 590. As the door pin 541, 542 is moved within the rotation space 594, 595, the lower door 540 may be moved to be separated from the reference line L. The lower discharge port 211*c* may be opened so that the air that passed through the pressurizing space 300*s* may be discharged upward through the lower discharge port 211*c*.

While the lower door 540 moves, the slide guide 543, 545 may also be moved by the rotation of the lower door 540. The guide protrusion 574 inserted into the slide guide 543, 545 may receive a driving force by the slide guide 543, 545. The guide protrusion 574 may be moved outward along the guide hole 544, 546. As the guide protrusion 574 moves, the slide link 550, 570 may be also simultaneously moved. The slide link 550, 570 may be rotated depending on the movement of the slide guide 543, 545.

Figure 12:
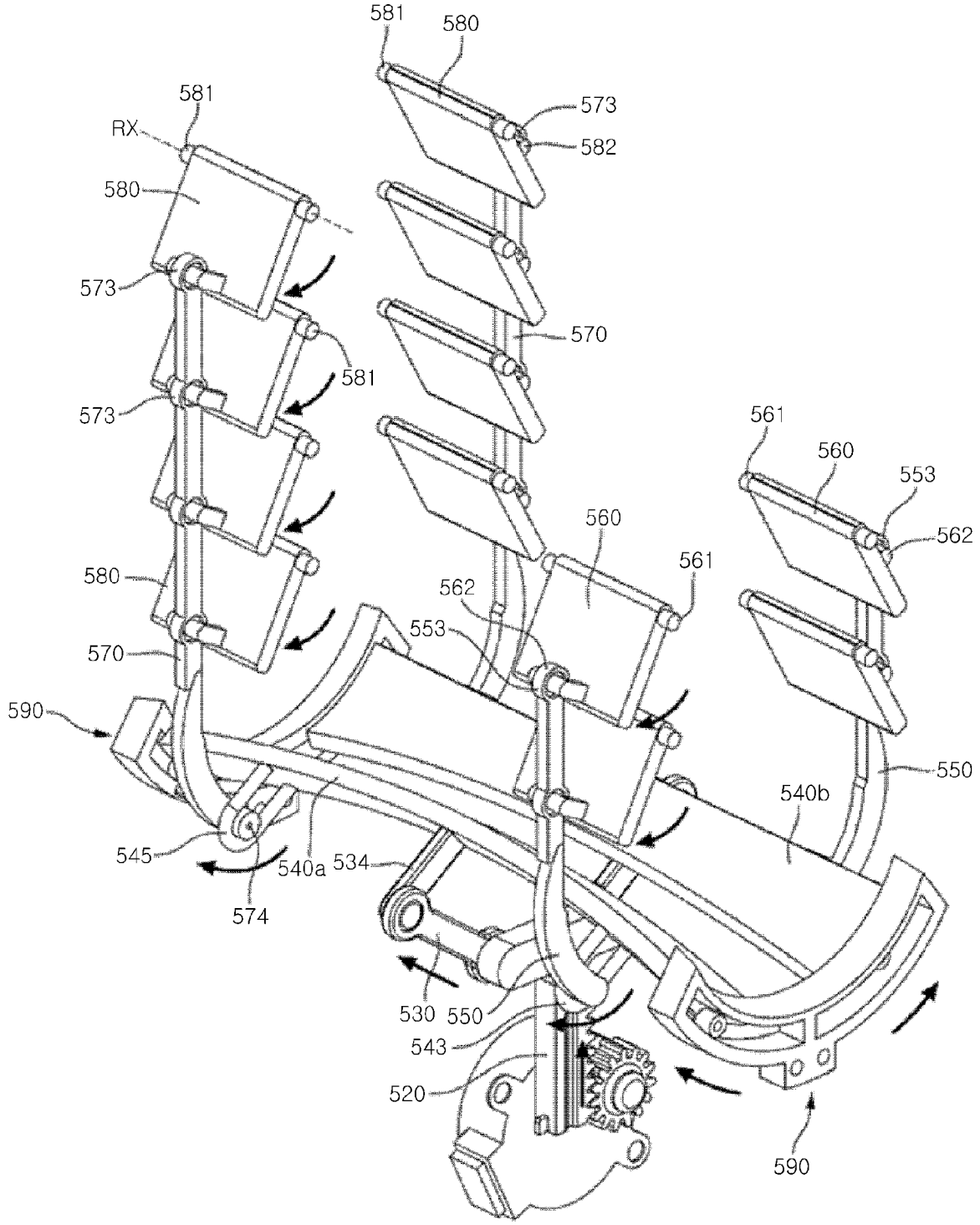
FIG. 12 is a diagram illustrating a driving principle of a closing and opening device according to an embodiment.

When the slide link 550, 570 is rotated, the front door 560 and the rear door 580 coupled to the slide link 550, 570 may be rotated (as indicated by the arrows of FIG. 12) with the door shaft 561, 581 as a rotation axis RX. The rotated front door 560 and rear door 580 may be inclined toward the blowing space S toward the upper side. The air discharged through the front discharge port 226, 236 and the rear discharge port 227, 237 may be guided upward by the front door 560 and the rear door 580, thereby forming an upward air current together with the air discharged from the lower discharge port 211*c*.

This application is related to U.S. application Ser. No. 17/190,692 filed on Mar. 3, 2021 and U.S. application Ser. No. 17/191,873 filed on Mar. 4, 2021, the entire contents of which are incorporated by reference herein.

Embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

Embodiments disclosed herein may provide air discharged upward through an auxiliary discharge port which is joined with air discharged through a main discharge port so that an airflow direction can be adjusted without changing a position of a case. Since a single door motor may simultaneously open and close a plurality of doors, a number of power sources to implement a rising wind is minimized, thereby improving energy efficiency. Whether to open or close the auxiliary discharge port can be varied according to a mode in which the blower is operated, thereby implementing various modes having different airflow directions through the opening and closing of the auxiliary discharge port.

Air discharged through the auxiliary discharge port and the air discharged through a lower discharge port may be merged and discharged upward, thereby reinforcing the rising air flow and improving the blowing performance. Since only a single door motor is controlled, it may be easier to control the rising wind than when controlling a plurality of doors simultaneously.

Embodiments disclosed herein may provide a blower capable of forming a blowing flow in various directions without changing a position. Embodiments disclosed herein may provide a blower having a compact structure and improved energy efficiency. Embodiment disclosed herein may implement various blowing modes accompanied by a change of the airflow direction. Embodiments disclosed herein may provide an improved blowing performance and an easy to control closing and opening device.

Embodiments disclosed herein may be implemented as a blower including a lower case and an upper case provided above the lower case. The lower case may have a suction port and a fan. A main discharge port may be formed in the upper case and discharge air introduced through the suction port to flow forward along a surface of the upper case.

The blower may include an auxiliary discharge port which is formed in the upper case, positioned in a front lower side of the main discharge port, and configured to discharge the air introduced through the suction port upward. The blower may further include a door which opens and closes the auxiliary discharge port and a door motor that provides power to the door so that an upward airflow can be formed by selectively opening and closing the auxiliary discharge port.

The main discharge port may be formed through a part of a side wall of the upper case. An outlet of the main discharge port may be positioned in front of an inlet of the main discharge port. The air discharged through the main discharge port may flow forward.

When the door opens the auxiliary discharge port, the air discharged through the auxiliary discharge port may interfere with the air discharged through the main discharge port so that the air discharged through the main discharge port may be converted into an upward airflow.

The upper case may include a tower base which is provided in the upper side of the lower case, a first tower case which extends upward from the tower base, and a second tower case which extends upward from the tower base. A blowing space may be formed between the first tower case and the second tower case.

The main discharge port may be formed by penetrating a part of a sidewall of the upper case toward the blowing space. The auxiliary discharge port may discharge the air introduced through the suction port upward toward the blowing space.

A plurality of auxiliary discharge ports may be formed. A plurality of doors may be provided to correspond to the plurality of auxiliary discharge ports. A single door motor may be provided to supply power to each of the plurality of doors so that the plurality of doors can be controlled by a single door motor.

The auxiliary discharge port may include a rear discharge port which is formed in at least one of the first tower case and the second tower case and positioned below the main discharge port, a front discharge port which is formed in at least one of the first tower case and the second tower case and spaced from a front of the rear discharge port, and a lower discharge port which is formed in the tower base and positioned below the front discharge port and the rear discharge port. A size of the front discharge port may be smaller than a size of the rear discharge port, thereby strengthening the upward airflow.

The door may include a front door to open and/or close the front discharge port, a rear door to open and close the rear discharge port, and a lower door to open and close the lower discharge port. The blower further may include a rotation guide into which a door pin protruding from the lower door is inserted.

The lower door may move along an upper surface of the tower base. The lower door may include a first lower door that is moved to one side by receiving power from the door motor and a second lower door that receives power from the door and moves in a direction opposite to the first lower door.

The blower may further include a motor gear which is connected to the door motor and rotated, a rack which has a teeth part or a plurality of teeth engaged with the motor gear, and a connection link which is connected to the rack and transmits power generated in the door motor to the door. The connection link may include a connection rod which is rotatably connected to the rack and a crank which has a joint protrusion inserted into the connection rod and connected to the door.

The door may include an upper door provided in an upper side of the lower door. The upper door may be connected to the lower door through a slide link that is extended in a vertical direction. The slide link may include a bent part or bend which is connected to the lower door and extended to be bent and an extension part or extension which extends upward from the bent part and is connected to the upper door.

The upper door may include a link coupling part extended in a front-rear direction and protruding from the upper door. The slide link may have a link hole through which the link coupling part passes.

A plurality of upper doors may be provided to be spaced apart vertically. The slide link may extend in a vertical direction to be connected to the plurality of upper doors. The lower door may include a slide guide, which extends downward from the lower door, into which the slide link is inserted.

The slide link may have a guide protrusion protruding toward the slide guide. The slide guide may have a guide hole, into which the guide protrusion is inserted, that is formed along an extension direction of the slide guide.

The upper door may be rotated about a door rotation shaft extended in a front-rear direction. The door rotation shaft may be provided in an upper end of the upper door. The blower may further include a fan motor which applies power to the fan and a motor housing in which the fan motor is received or accommodated.

The door motor may be provided inside the motor housing. The blower may further include a controller for controlling operation of the door. The controller may close the auxiliary discharge port in a first mode in which air is discharged forward. The controller may open the auxiliary discharge port in a second mode in which air is discharged upward.

Embodiments disclosed herein may be implemented as a blower comprising a lower case, an upper case provided above the lower case, a suction port formed in the lower case, a fan provided in the lower case and configured to suction air through the suction port, a main discharge port formed in the upper case and configured to discharge air introduced through the suction port, the main discharge port and the upper case configured to guide discharged air in a forward direction, at least one auxiliary discharge port formed in the upper case below the main discharge port, at least one louver configured to open or close the at least one auxiliary discharge port, respectively, and a louver motor configured to power the louver to open or close the auxiliary discharge port. The main discharge port may have an inlet and an outlet, the outlet being positioned at least partially in front of the inlet. When the louver may be opened to open the auxiliary discharge port, the air discharged through the auxiliary discharge port may be configured to mix with the air discharged through the main discharge port.

The upper case may include a first case provided at a first side, a second case provided at a second side and spaced apart from the first case to form a blowing space between the first and second cases, and a base from which the first and second cases extend. The main discharge port may be formed in an inner wall of at least one of the first case or the second case to face, the inner wall facing the blowing space, and the auxiliary discharge port may be formed in an inner wall of at least one of the first case or the second case.

The auxiliary discharge port may include a rear discharge port positioned below the main discharge port, a front discharge port formed in front of the rear discharge port to be in front of the main discharge port, and a lower discharge port formed in the base of the upper case such that air introduced from the lower case through the lower discharge port may be guided upward. A size of the front discharge port may be smaller than a size of the rear discharge port.

The louver may include a front louver configured to open or close the front discharge port, a rear louver configured to open or close the rear discharge port, and a lower louver configured to open or close the lower discharge port. The louver may include a pin protruding from the lower louver, and a rotation guide into which the pin may be inserted. The lower louver may move around the upper surface of the base.

The at least one auxiliary discharge port may include a plurality of auxiliary discharge ports. The at least one louver may include a plurality of louvers. A single louver motor may be provided to supply power to each of the plurality of louvers.

A gear may be coupled to the louver motor, the louver motor being configured to rotate the gear. A rack may be configured to engage with the gear. A connection link may be coupled to the rack and the louver to transmit power generated in the louver motor to the louver. The connection link may include a connection rod rotatably coupled to the rack, and a crank coupled to the louver and having a joint protrusion inserted into the connection rod.

The at least one auxiliary discharge port may include a lower discharge port formed in a base of the upper case and an upper discharge port formed in a sidewall of the upper case. Air introduced through the lower discharge port may be configured to flow upward. The at least one louver may include a lower louver configured to open or close the lower discharge port, an upper louver configured to open or close the upper discharge port, and a slide link coupling the lower louver to the upper louver such that, when the lower louver may be moved, the upper louver may be moved for opening or closing the lower and upper discharge ports.

The slide link may include a bent extension connected to the lower louver and extended to be bent and an extension extending upward from the bend and connected to the upper louver. The upper louver may include a connector protruding from the upper louver, and the slide link may have a link hole through which the connector passes.

The lower louver may include a slide guide extending downward from the lower louver, the slide link being inserted into the slide guide. The slide link may have a guide protrusion protruding toward the slide guide, the slide guide has a guide slot extending in an extension direction of the slide guide, and the guide protrusion may be inserted into the guide hole to move within the guide slot.

The louver may include an upper louver rotated about a louver rotation shaft extended in a front-rear direction. The louver rotation shaft may be provided in an upper end of the upper louver.

A fan motor may be configured to power the fan. The fan motor may be provided in a motor housing. The louver motor may be provided inside the motor housing.

A controller may be configured to control an operation of the louver. The controller may be configured to close the auxiliary discharge port in a first mode in which air may be discharged forward, and configured to open the auxiliary discharge port in a second mode in which air may be discharged upward.

The upper case may include a first case and a second case spaced apart from the first case to define a blower space therebetween, the blower space extending in a front-rear direction. The blower may further include a first slit defined in the first case, a second slit defined in the second case, a first board configured to be inserted into the first case and pulled out of the first case via the first slit, and a second board configured to be inserted into the second case and pulled out of the second case via the second slit.

When the first and second boards are pulled out of the first and second cases, respectively, the first and second boards may block a front of the blower space to prevent air from flowing forward and to guide air upward. In the first mode, the first and second boards may be controlled to be inserted into the first and second cases to allow air discharged from the main discharge port to flow forward through the blower space. In the second mode, the first and second boards may be controlled to be pulled out of the first and second cases to guide forward flowing air discharged from the main and auxiliary discharge ports upward.

Although the embodiments of the present disclosure have been disclosed for illustrative purposes, those skilled in the art will appreciate that various modifications, additions and substitutions are possible, without departing from the scope and spirit of the invention as disclosed in the accompanying claims. Accordingly, the scope of the present disclosure is not construed as being limited to the described embodiments but is defined by the appended claims as well as equivalents thereto.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a lower case having a suction port;

an upper case provided above the lower case and including a first case and a second case, and wherein a first case includes a first wall, and wherein a second case is spaced apart from the first case and including a second wall facing the first wall;

a blowing space formed between the first wall and the second wall, wherein a front side and an upper side of the blowing space is opened;

a fan provided in the lower case and configured to suction air through the suction port;

a first main discharge port formed at the first wall to discharge air in the first case to the blowing space, and configured to discharge air in a first direction;

a second main discharge port formed at the second wall to discharge air in the second case to the blowing space, and configured to discharge air in the first direction;

at least one auxiliary discharge port formed in the upper case opened toward the blowing space to discharge air in the upper case to the blowing space, and configured to discharge air in a second direction; and at least one louver configured to open or close the at least one auxiliary discharge port, respectively, and wherein a first airflow discharged from the first and second main discharge ports and a second airflow discharged from the at east one auxiliary discharge port are mixed in the blowing space, and then discharged out of the blower.

2. The blower of claim 1, wherein the main discharge port has an inlet and an outlet, the outlet being positioned at least partially in front of the inlet.

3. The blower of claim 1, wherein, a direction of an airflow discharged out of the blower s changing according to a degree to which the at least one louver opens the at least one auxiliary discharge port.

4. The blower of claim 1, wherein the upper case further comprises a base disposed between the lower case and the first and second cases, and wherein the at least one auxiliary discharge port is formed in at least one of the first wall or the second wall or the base.

5. The blower of claim 4, wherein the at least one auxiliary discharge port comprises:

a rear discharge port positioned closer to the lower case than the first and second main discharge ports;

a front discharge port formed in front of the rear discharge port to be in front of the first and second main discharge ports; and a lower discharge port formed in the base of the upper case and positioned closer to the lower case than the front discharge port and the rear discharge port.

6. The blower of claim 5, wherein a size of the front discharge port is smaller than a size of the rear discharge port.

7. The blower of claim 5, wherein the at least one louver comprises:

a front louver configured to open or close the front discharge port;

a rear louver configured to open or close the rear discharge port; and a lower louver configured to open or close the lower discharge port.

8. The blower of claim 7, wherein the at least one louver includes:

a pin protruding from the lower louver; and a rotation guide into which the pin is inserted, wherein the lower louver moves along the upper surface of the base.

9. The blower of claim 4, wherein the at least one auxiliary discharge port includes a lower discharge port formed in the base of the upper case and an upper discharge port formed in the first and second wall of the upper case, and wherein the at least one louver comprises:

a lower louver configured to open or close the lower discharge port;

an upper louver configured to open or close the upper discharge port; and a slide link coupling the lower louver to the upper louver.

10. The blower of claim 9, wherein the slide link comprises:

a bent extension connected to the lower louver and extended to be bent; and an extension extending upward from the bend and connected to the upper louver.

11. The blower of claim 9, wherein the upper louver comprises a connector protruding from the upper louver, and the slide link has a link hole through which the connector passes.

12. The blower of claim 9, wherein the lower louver comprises a slide guide extending downward from the lower louver, the slide link being inserted into the slide guide.

13. The blower of claim 12, wherein the slide link has a guide protrusion protruding toward the slide guide, the slide guide has a guide slot extending in an extension direction of the slide guide, and the guide protrusion is inserted into the guide hole to move within the guide slot.

14. The blower of claim 1, wherein the at least one louver includes an upper louver rotated about a louver rotation shaft extended in a front-rear direction, wherein the louver rotation shaft is provided in an upper end of the upper louver.

15. The blower of claim 1, further comprising a controller configured to control an operation of the at least one louver, Wherein the controller is configured to close the at least one auxiliary discharge port in a first mode in which air is discharged in the first direction, and configured to open the at least one auxiliary discharge port in a second mode in which air is discharged in the second direction.

16. The blower of claim 1, further comprising:

a first slit defined in the first case and disposed in front of the first main discharge port;

a second slit defined in the second case and disposed in front of the second main discharge port;

a first board configured to be inserted into the first case and pulled out of the first case via the first slit; and a second board configured to be inserted into the second case and pulled out of the second case via the second slit;

wherein:

when the first and second boards are pulled out of the first and second cases, respectively, the first and second boards block the front side of the blowing space to prevent air from flowing in the first direction and to guide air in the second direction, in the first mode, the first and second boards are controlled to be inserted into the first and second cases to allow air discharged from the first and second main discharge ports to flow in the first direction through the blowing space, and in the second mode, the first and second boards are controlled to be pulled out of the first and second cases to guide air discharged from the first and second main discharge ports and the at least one auxiliary discharge ports.

17. The blower of claim 1, further comprising a louver motor configured to power the at least one louver to open or close the at least one auxiliary discharge port.

18. The blower of claim 17, further comprising:

a fan motor configured to power the fan; and a motor housing in which the fan motor is provided, wherein the louver motor is provided inside the motor housing.

19. The blower of claim 17, wherein the at least one auxiliary discharge port includes a plurality of auxiliary discharge ports, the at least one louver includes a plurality of louvers, and a single one of the louver motor is provided to supply power to each of the plurality of louvers.

20. The blower of claim 17, further comprising:

a gear coupled to the louver motor, the louver motor being configured to rotate the gear;

a rack configured to engage with the gear; and a connection link coupled to the rack and the at least one louver to transmit power generated in the louver motor to the at least one louver.

21. The blower of claim 20, wherein the connection link comprises:

a connection rod rotatably coupled to the rack; and a crank coupled to the at least one louver and having a joint protrusion inserted into the connection rod.

22. The blower of claim 1, wherein the at least one auxiliary discharge port is formed closer to the lower case than the first and second main discharge ports.

23. The blower of claim 22, wherein the at least one auxiliary discharge port is provided on a same vertical line with the first and second main discharge ports.

24. The blower of claim 22, wherein the at least one auxiliary discharge port is provided in closer to the front side of blowing space than the front and second main discharge ports.

25. A blower, comprising:

a lower case including a suction port;

an upper case provided above the lower case and including a first tower and a second tower spaced apart from each other, the first tower and the second tower defining a blowing space therebetween;

a fan provided configured to blow air from the suction port and into the upper case;

at least one main discharge port provided on at least one of the first tower or the second tower and configured to discharge air into the blowing space in a first direction;

at least one auxiliary discharge port provided on at least one of the first tower, the second tower, or a surface of the upper case between the first and second towers; and at least one louver configured to open or close the at least one auxiliary discharge port, respectively, wherein, when the at least one louver is opened to open the at least one auxiliary discharge port, the at least one auxiliary discharge port is configured to discharge air into the blowing space in a second direction to mix with the air discharged through the main discharge port.

* * * * *